US008322408B2

(12) United States Patent
Yoshioka et al.

(10) Patent No.: US 8,322,408 B2
(45) Date of Patent: Dec. 4, 2012

(54) HEAT EXCHANGER AND AIR CONDITIONER

(75) Inventors: Shun Yoshioka, Osaka (JP); Shuji Ikegami, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 601 days.

(21) Appl. No.: 11/631,382

(22) PCT Filed: Jun. 30, 2005

(86) PCT No.: PCT/JP2005/012109

§ 371 (c)(1),
(2), (4) Date: Dec. 29, 2006

(87) PCT Pub. No.: WO2006/004009

PCT Pub. Date: Jan. 12, 2006

(65) Prior Publication Data

US 2008/0035321 A1 Feb. 14, 2008

(30) Foreign Application Priority Data

Jun. 30, 2004 (JP) ..... 2004-192589

(51) Int. Cl.

| | |
|---|---|
| ***B21D 53/06*** | (2006.01) |
| ***B23P 15/26*** | (2006.01) |
| ***F28F 1/30*** | (2006.01) |
| ***F28F 1/20*** | (2006.01) |
| ***F28D 1/04*** | (2006.01) |
| ***F25D 23/00*** | (2006.01) |
| ***F25B 39/02*** | (2006.01) |

(52) U.S. Cl. ..... 165/182; 165/151; 165/181; 62/515; 62/271; 29/890.046; 29/890.047

(58) Field of Classification Search ..... 62/176.1, 62/271, 515; 165/151, 181, 182; 29/890.046
See application file for complete search history.

(56) References Cited

U.S. PATENT DOCUMENTS

| | | | | | |
|---|---|---|---|---|---|
| 1,915,742 | A | * | 6/1933 | Mautsch | 165/151 |
| 3,091,289 | A | * | 5/1963 | Weinstein | 165/55 |
| 3,443,634 | A | * | 5/1969 | Pasternak | 165/182 |
| 3,796,258 | A | * | 3/1974 | Malhotra et al. | 165/151 |
| 3,902,551 | A | | 9/1975 | Lim et al. | |
| 4,705,105 | A | | 11/1987 | Cur | |
| 4,775,007 | A | * | 10/1988 | Sakuma et al. | 165/151 |
| 4,923,002 | A | * | 5/1990 | Haussmann | 165/151 |
| 5,056,594 | A | * | 10/1991 | Kraay | 165/151 |
| 5,318,112 | A | * | 6/1994 | Gopin | 165/151 |

(Continued)

FOREIGN PATENT DOCUMENTS

GB 1 576 441 10/1980

(Continued)

*Primary Examiner* — Marc Norman
*Assistant Examiner* — Filip Zec
(74) *Attorney, Agent, or Firm* — Birch, Stewart, Kolasch & Birch, LLP.

(57) ABSTRACT

In a heat exchanger for exchanging heat between fluid such as refrigerant and air, an object of the present invention is to extend the surface area of fins while suppressing an increase in ventilation resistance, thereby improving performances of the heat exchanger. Corrugated sheet fins (70) are provided as the fins of the heat exchanger (60). The corrugated sheet fins (70) are each shaped like a corrugated sheet. The ridgeline direction of the waveform of the corrugated sheet fins (70) is orthogonal to front edges and rear edges. In the heat exchanger (60), the plurality of corrugated sheet fins (70) are arranged at constant pitches in the axial direction of the heat transfer tube (61).

12 Claims, 19 Drawing Sheets

U.S. PATENT DOCUMENTS

| | | | | |
|---|---|---|---|---|
| 6,041,617 | A * | 3/2000 | Sanada et al. | 62/480 |
| 6,102,107 | A * | 8/2000 | Dunne | 165/104.12 |
| 6,725,909 | B1 * | 4/2004 | Luo | 165/104.21 |
| 2005/0051294 | A1 | 3/2005 | Fujita et al. | |

FOREIGN PATENT DOCUMENTS

| | | | |
|---|---|---|---|
| JP | 3-30062 | U | 3/1991 |
| JP | 5-99581 | A | 4/1993 |
| JP | 8-944 | A | 1/1996 |
| JP | 10-166088 | A | 6/1998 |
| JP | 11-347335 | A | 12/1999 |
| JP | 2001-227889 | A | 8/2001 |
| JP | 2001-304783 | A | 10/2001 |
| JP | 2004-85013 | A | 3/2004 |
| JP | 2004-162885 | A | 6/2004 |

* cited by examiner (A)

(B)

HEAT EXCHANGER AND AIR CONDITIONER

TECHNICAL FIELD

The present invention relates to a heat exchanger and an air conditioner with the heat exchanger.

BACKGROUND ART

Conventionally, a heat exchanger for exchanging heat between fluid such as a refrigerant and air has been known and widely used in air conditioners and similar apparatuses. As such heat exchanger, as disclosed in Patent document 1, for example, a heat exchanger in which a multiplicity of flat sheet-like fins are arranged along a heat transfer tube at predetermined pitches is known. In this type of heat exchanger, fluid such as refrigerant flows through the heat transfer tube, while air passes between the fins disposed at the predetermined pitches, thereby exchanging heat between the fluid and air.

Patent document 1: Unexamined Patent Publication No. 2001-304783

DISCLOSURE OF THE INVENTION

Problems to be Solved by the Invention

Generally, to improve performances of the heat exchanger, a method of extending the surface area of fins, that is, the heat transfer area on the side of air, is effective. On the other hand, in the above-mentioned heat exchanger using the flat sheet fins and the heat transfer tube, to increase the surface area of the fins, the pitches between the fins need to be shortened. However, in this type of heat exchanger, when the pitches between the fins become shorter, an area where air passes is narrowed and ventilation resistance is increased. For this reason, there is a limit in improving performances of the heat exchanger by shortening the pitches between the fins.

In consideration of these circumstances, an object of the present invention is to extend the surface area of fins while suppressing an increase in ventilation resistance in a heat exchanger for exchanging heat between fluid such as refrigerant and air, thereby improving performances of the heat exchanger. Another object of the present invention is to provide an air conditioner using such high-performance heat exchanger.

Means to Solve the Problems

A first aspect of the invention relates to a heat exchanger which comprises a heat transfer tube (61) and a plurality of fins arranged in an axial direction of the heat transfer tube (61) and exchanges heat between fluid flowing through the heat transfer tube (61) and air flowing between the fins. Corrugated sheet-like corrugated sheet fins (70) are provided as the fins, an amplitude direction of the waveform of the corrugated sheet fins (70) is substantially parallel to an axial direction of the heat transfer tube (61), and a ridgeline direction of the waveform of the corrugated sheet fins (70) is substantially orthogonal to a front surface and a back surface of the heat exchanger.

According to a second aspect of the invention, in the first aspect of the invention, an amplitude of the waveform of the corrugated sheet fins (70) is equal to a pitch between the corrugated sheet fins (70).

A third aspect of the invention relates to a heat exchanger which comprises a heat transfer tube (61) and a plurality of fins arranged in an axial direction of the heat transfer tube (61) and exchanges heat between fluid flowing through the heat transfer tube (61) and air flowing between the fins. A plurality of flat sheet fins (65) which each are formed in the shape of a flat sheet and a plurality of corrugated sheet fins (70) which each are formed in the shape of a corrugated sheet are provided as the fins. The flat sheet fins (65) and the corrugated sheet fins (70) are alternately arranged in the axial direction of the heat transfer tube (61), an amplitude direction of the waveform of the corrugated sheet fins (70) is substantially parallel to an axial direction of the heat transfer tube (61), and a ridgeline direction of the waveform of the corrugated sheet fins (70) is substantially orthogonal to a front surface and a back surface of the heat exchanger.

According to a fourth aspect of the invention, in the third aspect of the invention, each corrugated sheet fin (70) is in contact with the flat sheet fins (65) located on both sides of the corrugated sheet fin (70).

According to a fifth aspect of the invention, in the third aspect of the invention, the flat sheet fins (65) and the corrugated sheet fins (70) have through holes (66, 75) for inserting the heat transfer tubes (61) therethrough.

According to a sixth aspect of the invention, in the fifth aspect of the invention, cylindrical first collars (67) which are continuous with the peripheries of the through holes (66) are protrudingly provided on the flat sheet fins (65) and cylindrical second collars (76) which are continuous with the peripheries of the through holes (75) are protrudingly provided on the corrugated sheet fin (70), the first collars (67) are inserted into the second collars (76), thereby bringing the inner circumferential surfaces of the second collars (76) into close contact with the outer circumferential surfaces of the first collars (67), while the heat transfer tubes (61) are inserted into the first collars (67), thereby bringing the inner circumferential surfaces of the first collars (67) into close contact with the outer circumferential surfaces of the heat transfer tubes (61).

According to a seventh aspect of the invention, in the fifth aspect of the invention, cylindrical first collars (67) which are continuous with the peripheries of the through holes (66) are protrudingly provided on the flat sheet fins (65) and cylindrical second collars (76) which are continuous with the peripheries of the through holes (75) are protrudingly provided on the corrugated sheet fin (70), the second collars (76) are inserted into the first collars (67), thereby bringing the outer circumferential surfaces of the second collars (76) into close contact with the inner circumferential surfaces of the first collars (67), while the heat transfer tubes (61) are inserted into the second collars (76), thereby bringing the inner circumferential surfaces of the second collars (76) into close contact with the outer circumferential surfaces of the heat transfer tubes (61).

According to an eighth aspect of the invention, in the third aspect of the invention, the flat sheet fins (65) have through holes (66) for inserting the heat transfer tubes (61) therethrough and are in close contact with the heat transfer tubes (61) inserted through the through holes (66), while each corrugated sheet fin (70) is held between a pair of the flat sheet fins (65) located on both sides of the corrugated sheet fin (70).

According to a ninth aspect of the invention, in the first aspect of the invention, flat portions (78) are formed along sides of the corrugated sheet fins (70) orthogonal to the ridgeline direction of the waveform thereof.

According to a tenth aspect of the invention, in the third aspect of the invention, flat portions (78) are formed along sides of the corrugated sheet fins (70) orthogonal to the ridgeline direction of the waveform thereof.

According to an eleventh aspect of the invention, in any one of the first to tenth aspects of the invention, adsorption layers made of adsorbent are formed on the fins and moisture is transferred between air passing between the fins and the adsorption layers.

According to a twelfth aspect of the invention, in any one of the third to eighth aspects of the invention, the adsorption layers made of adsorbent are formed on the surfaces of either the flat sheet fins (65) or the corrugated sheet fins (70), and moisture is transferred between air passing between the flat sheet fins (65) and the corrugated sheet fins (70) and the adsorption layers.

A thirteenth and a fourteenth aspects of the invention relate to an air conditioner which comprises a temperature control part (55) for processing sensible heat load and humidity control parts (56, 57) for processing latent heat load and performs at least a cooling and dehumidification operation of cooling air supplied indoors by the temperature control part (55) and dehumidifying air supplied indoors by the humidity control parts (56, 57).

According to a thirteenth aspect of the invention, the humidity control parts (56, 57) control water content in air by using adsorbent which adsorbs moisture in the air, the temperature control part (55) is formed of a temperature control heat exchanger (55) which exchanges heat between the heating medium for cooling and air in the cooling and dehumidification operation, the temperature control heat exchanger (55) has a heat transfer tube (61) and a plurality of fins in the axial direction of the heat transfer tube (61), exchanges heat between fluid flowing through the heat transfer tube (61) and air flowing between the fins and has corrugated sheet fins (70) shaped like a corrugated sheet as the fins, and an amplitude direction of the waveform of the corrugated sheet fins (70) is substantially parallel to an axial direction of the heat transfer tube (61), and a ridgeline direction of the waveform of the corrugated sheet fins (70) is substantially orthogonal to a front surface and a back surface of the temperature control heat exchanger (55).

According to a fourteenth aspect of the invention, the humidity control parts (56, 57) control water content in air by using adsorbent which adsorbs moisture in the air, the temperature control part (55) is formed of a temperature control heat exchanger (55) which exchanges heat between the heating medium for cooling and air in the cooling and dehumidification operation, the temperature control heat exchanger (55) has a heat transfer tube (61) and a plurality of fins in the axial direction of the heat transfer tube (61), exchanges heat between fluid flowing through the heat transfer tube (61) and air flowing between the fins and has a plurality of flat sheet fin (65) shaped like a flat sheet and a plurality of corrugated sheet fins (70) shaped like a corrugated sheet as the fins, in the temperature control heat exchanger (55), the flat sheet fins (65) and the corrugated sheet fins (70) are alternately arranged in the axial direction of the heat transfer tube (61), and an amplitude direction of the waveform of the corrugated sheet fins (70) is substantially parallel to an axial direction of the heat transfer tube (61), and a ridgeline direction of the waveform of the corrugated sheet fins (70) is substantially orthogonal to a front surface and a back surface of the temperature control heat exchanger (55).

A fifteenth, a sixteenth and a seventeenth aspects of the invention relate to an air conditioner which comprises a heat exchanger (60) and a heating medium circuit (40) for supplying a heating medium for cooling or heating to a heat transfer tube (61) of the heat exchanger (60), alternately performs a motion of supplying the heating medium for cooling to the heat transfer tube (61) of the heat exchanger (60), thereby allowing an adsorption layer of the heat exchanger (60) to adsorb moisture in air and a motion of supplying the heating medium for heating to the heat transfer tube (61) of the heat exchanger (60), thereby giving to the air the moisture desorbed from the adsorption layer of the heat exchanger (60), supplies one of the air dehumidified by the heat exchanger (60) and the air humidified by the heat exchanger (60) indoors and discharges the other of the air dehumidified by the heat exchanger (60) and the air humidified by the heat exchanger (60) outdoors.

According to a fifteenth aspect of the invention, the heat exchanger comprises a heat transfer tube (61) and a plurality of fins arranged in an axial direction of the heat transfer tube (61) and exchanges heat between fluid flowing through the heat transfer tube (61) and air flowing between the fins, in the heat exchanger (60), adsorption layers made of adsorbent are formed on surfaces of the fins and moisture is transferred between air passing between the fins and the adsorption layers, and corrugated sheet-like corrugated sheet fins (70) are provided as the fins, an amplitude direction of the waveform of the corrugated sheet fins (70) is substantially parallel to an axial direction of the heat transfer tube (61), and a ridgeline direction of the waveform of the corrugated sheet fins (70) is substantially orthogonal to a front surface and a back surface of the heat exchanger (60).

According to a sixteenth aspect of the invention, the heat exchanger (60) comprises a heat transfer tube (61) and a plurality of fins arranged in an axial direction of the heat transfer tube (61) and exchanges heat between fluid flowing through the heat transfer tube (61) and air flowing between the fins, in the heat exchanger (60), adsorption layers made of adsorbent are formed on surfaces of the fins and moisture is transferred between air passing between the fins and the adsorption layers, a plurality of flat sheet fins (65) which each are formed in the shape of a flat sheet and a plurality of corrugated sheet fins (70) which each are formed in the shape of a corrugated sheet are provided as the fins, in the heat exchanger (60), the flat sheet fins (65) and the corrugated sheet fins (70) are alternately arranged in the axial direction of the heat transfer tube (61), and an amplitude direction of the waveform of the corrugated sheet fins (70) is substantially parallel to an axial direction of the heat transfer tube (61), and a ridgeline direction of the waveform of the corrugated sheet fins (70) is substantially orthogonal to a front surface and a back surface of the heat exchanger.

According to a seventeenth aspect of the invention, the heat exchanger comprises a heat transfer tube (61) and a plurality of fins arranged in an axial direction of the heat transfer tube (61) and exchanges heat between fluid flowing through the heat transfer tube (61) and air flowing between the fins, and a plurality of flat sheet fins (65) which each are formed in the shape of a flat sheet and a plurality of corrugated sheet fins (70) which each are formed in the shape of a corrugated sheet are provided as the fins, in the heat exchanger (60), the flat sheet fins (65) and the corrugated sheet fins (70) are alternately arranged in the axial direction of the heat transfer tube (61), and an amplitude direction of the waveform of the corrugated sheet fins (70) is substantially parallel to an axial direction of the heat transfer tube (61), and a ridgeline direction of the waveform of the corrugated sheet fins (70) is substantially orthogonal to a front surface and a back surface of the heat exchanger, and in the heat exchanger (60), the adsorption layers made of adsorbent are formed on the surfaces of either the flat sheet fins (65) or the corrugated sheet fins (70), and moisture is transferred between air passing between the flat sheet fins (65) and the corrugated sheet fins (70) and the adsorption layers.

-Operation-

According to the first aspect of the invention, the corrugated sheet fins (70) are provided in the heat exchanger (60) as the fins. In the heat exchanger (60), the plurality of corrugated sheet fins (70) are arranged in the axial direction of the heat transfer tube (61). In the heat exchanger (60), air passes between the corrugated sheet fins (70) from the front surface toward the back surface of the heat exchanger (60). In the corrugated sheet fins (70), the amplitude direction of the waveform is substantially parallel to the axial direction of the heat transfer tube (61). In the corrugated sheet fins (70), the ridgeline direction of the waveform is substantially orthogonal to the front surface and the back surface of the heat exchanger (60). That is, the ridgeline direction of the waveform of the corrugated sheet fins (70) substantially corresponds to the air passage direction in the heat exchanger (60). The corrugated sheet fins (70) are each shaped like a corrugated sheet and thus have a larger surface area than fins shaped like a flat sheet of the same size. When the corrugated sheet fins (70) are provided in the heat exchanger (60) as fins, a heat transfer area with air can be increased without making the pitch between the fins smaller.

According to the second aspect of the invention, an amplitude of the waveform of the corrugated sheet fins (70) is equal to a pitch between the corrugated sheet fins (70) arranged in the axial direction of the heat transfer tube (61).

According to the third aspect of the invention, the flat sheet fins (65) and the corrugated sheet fins (70) are provided as the fins. In the heat exchanger (60), the flat sheet fins (65) and the corrugated sheet fins (70) are alternately arranged in the axial direction of the heat transfer tube (61). In the heat exchanger (60), air passes between the corrugated sheet fins (70) from the front surface toward the back surface of the heat exchanger (60). In the corrugated sheet fins (70), the amplitude direction of the waveform is substantially parallel to the axial direction of the heat transfer tube (61). In the corrugated sheet fins (70), the ridgeline direction of the waveform is substantially orthogonal to the front surface and the back surface of the heat exchanger (60). That is, the ridgeline direction of the waveform of the corrugated sheet fins (70) substantially corresponds to the air passage direction in the heat exchanger (60). The corrugated sheet fins (70) are each shaped like a corrugated sheet and thus have a larger surface area than fins shaped like a flat sheet of the same size. When the corrugated sheet fins (70) are provided in the heat exchanger (60) as fins, a heat transfer area with air can be increased without making the pitch between the fins smaller.

According to the fourth aspect of the invention, each corrugated sheet fin (70) is in contact with the flat sheet fins (65) located on both sides of the corrugated sheet fin (70). That is, top portions of the waveform of the corrugated sheet fin (70) are in contact with one of adjacent flat sheet fins (65). Bottom portions of the waveform of the corrugated sheet fin (70) are into contact with the other of adjacent flat sheet fins (65).

According to the fifth aspect of the invention, through holes (66, 75) are formed on the flat sheet fins (65) and the corrugated sheet fins (70), respectively. In the heat exchanger (60), heat transfer tubes (61) are inserted into the through holes (66, 75) of the flat sheet fins (65) and the corrugated sheet fins (70), resulting in the state where the heat transfer tubes (61) pass through the flat sheet fins (65) and the corrugated sheet fin (70).

According to the sixth and seventh aspects of the invention, the first collars (67) are formed on the flat sheet fins (65) and the second collars (76) are formed on the corrugated sheet fins (70). In each flat sheet fin (65), the first collar (67) is formed to be cylindrical and continuous with the periphery of the through hole (66). In each corrugated sheet fin (70), the second collar (76) is formed to be cylindrical and continuous with the periphery of the through hole (75).

According to the sixth aspect of the invention, the first collars (67) of the flat sheet fins (65) are inserted into the second collars (76) of the corrugated sheet fins (70) and the heat transfer tubes (61) are inserted into the first collars (67) of the flat sheet fins (65). In the heat exchanger (60), by bringing the inner circumferential surfaces of the first collars (67) into close contact with the outer circumferential surfaces of the heat transfer tubes (61), the flat sheet fins (65) are fixed to the heat transfer tubes (61). In the heat exchanger (60), by bringing the inner circumferential surfaces of the second collars (76) into close contact with the outer circumferential surfaces of the first collars (67), the corrugated sheet fins (70) are fixed to the flat sheet fins (65).

According to the seventh aspect of the invention, the second collars (76) of the corrugated sheet fins (70) are inserted into the first collars (67) of the flat sheet fins (65) and the heat transfer tubes (61) are inserted into the second collars (76) of the corrugated sheet fins (70). In the heat exchanger (60), by bringing the inner circumferential surfaces of the second collars (76) into close contact with the outer circumferential surfaces of the heat transfer tubes (61), the corrugated sheet fins (70) are fixed to the outer circumferential surfaces of the heat transfer tubes (61). In the heat exchanger (60), by bringing the inner circumferential surfaces of the second collars (76) into close contact with the outer circumferential surfaces of the first collars (67), the corrugated sheet fins (70) are fixed to the flat sheet fins (65).

According to the eighth aspect of the invention, through holes (66) are formed on the flat sheet fin (65). In the heat exchanger (60), the heat transfer tubes (61) are inserted into the through holes (66) of the flat sheet fins (65), resulting in the state where the heat transfer tubes (61) pass through the flat sheet fins (65). The flat sheet fins (65) are in close contact with the heat transfer tubes (61) inserted through the through holes (66). On the other hand, the corrugated sheet fin (70) is held between a pair of the flat sheet fins (65) located on both sides of the corrugated sheet fin (70). That is, in the heat exchanger (60) according to this aspect of the invention, the corrugated sheet fin (70) is maintained by being held between the flat sheet fins (65) fixed to the heat transfer tubes (61).

According to the ninth and tenth aspects of the invention, the flat portions (78) are formed on the corrugated sheet fins (70). In the corrugated sheet fins (70), the flat portions (78) are formed along sides of the corrugated sheet fin (70) which are orthogonal to the ridgeline direction of the waveform thereof. In the corrugated sheet fins (70), the flat portion (78) may be formed along one of the two sides orthogonal to the ridgeline direction of the waveform thereof or may be formed along both of the two sides orthogonal to the ridgeline direction of the waveform thereof.

According to the eleventh aspect of the invention, adsorption layers are formed on the surfaces of the fins. That is, when the heat exchanger (60) is provided with the corrugated sheet fins (70), the adsorption layers are formed on the surfaces of the corrugated sheet fin (70). When the heat exchanger (60) is provided with both the flat sheet fins (65) and the corrugated sheet fins (70), the adsorption layers are formed on the surfaces of the flat sheet fins (65) and the surfaces of the corrugated sheet fins (70). In the heat exchanger (60) according to this aspect of the invention, air passing between the fins comes into contact with the adsorption layers and moisture is transferred between the air and the adsorption layers. For example, when heating medium for cooling is supplied to the heat transfer tubes (61), adsorption of moisture in air in the adsorption layers is accelerated. When heating medium for heating is supplied to the heat transfer tubes (61), desorption of moisture from the adsorption layers is accelerated.

According to the twelfth aspect of the invention, in the heat exchanger (60) provided with both the flat sheet fins (65) and the corrugated sheet fins (70), the adsorption layers are formed on the surfaces of either the flat sheet fins (65) or the corrugated sheet fins (70). In the heat exchanger (60) according to this aspect of the invention, air passing between the flat sheet fins (65) and the corrugated sheet fins (70) comes into contact with the adsorption layers and moisture is transferred between the air and the adsorption layers. For example, when the heating medium for cooling is supplied to the heat transfer tubes (61), adsorption of moisture in air in the adsorption layers is accelerated. When the heating medium for heating is supplied to the heat transfer tubes (61), desorption of moisture from the adsorption layers is accelerated.

According to the thirteenth and fourteenth aspects of the invention, the temperature control part (55) and the humidity control parts (56, 57) are provided in the air conditioner (10). The temperature control part (55) processes indoor sensible heat load by adjusting temperature of the air supplied indoors. The humidity control parts (56, 57) process indoor latent heat load by adjusting humidity of the air supplied indoors. The air conditioner (10) performs at least a cooling and dehumidification operation. During the cooling and dehumidification operation, the temperature control part (55) cools the air supplied indoors and the humidity control parts (56, 57) dehumidify the air supplied indoors.

The temperature control part (55) according to these aspects of the invention is formed of the temperature control heat exchanger (55) formed of the heat exchanger (60) according to any one of the first to ninth aspects of the invention. That is, the temperature control heat exchanger (55) is formed of the heat exchanger (60) provided with the corrugated sheet fins (70). During the cooling and dehumidification operation of the air conditioner (10), the heating medium for cooling is supplied to the heat transfer tubes (61) of the temperature control heat exchanger (55), thereby cooling air passing through the temperature control heat exchanger (55). On the other hand, the humidity control parts (56, 57) adjust water content in air by use of the adsorbent. During the cooling and dehumidification operation of the air conditioner (10), the humidity control parts (56, 57) allow the air supplied indoors to come into contact with the adsorbent, thereby adsorbing moisture contained in the air by the adsorbent.

Here, when the heating medium for cooling is supplied to the heat transfer tubes (61) of the heat exchanger (60), moisture in air may condense on the surfaces of the fins. In such case, it is necessary to process condensed water (drain water) generated on the surfaces of the fins. On the contrary, in the heat exchanger (60) according to the tenth aspect of the invention, since moisture in air is adsorbed by the adsorption layers on the surfaces of the fins, even when the heating medium for cooling is supplied to the heat transfer tubes (61), drain water is hardly generated or is not generated at all on the surfaces of the fins. In the air conditioner (10) according to the thirteenth and fourteenth aspects of the invention, since the temperature control parts (56, 57) process latent heat load by adjusting temperature of air, the temperature control part (55) only needs to process the sensible heat load. Accordingly, in the temperature control heat exchanger (55) forming the temperature control part (55), even when the heating medium for cooling is supplied to the heat transfer tubes (61), drain water is hardly generated or is not generated at all on the surfaces of the fins. The heat exchanger (60) having the corrugated sheet fins (70) according to the first to ninth aspects of the invention is suitable for applications which do not require such processing of drain water.

According to the fifteenth, sixteenth and seventeenth aspects of the invention, the heat exchanger according to the eleventh or twelfth aspect of the invention, that is, the heat exchanger having the adsorption layers and the heating medium circuit (40) connected to the heat transfer tube (61) of the heat exchanger are provided in the air conditioner (10). The air conditioner (10) alternately performs the motion of supplying the heating medium for cooling to the heat transfer tube (61) of the heat exchanger and the motion of supplying the heating medium for heating to the heat transfer tube (61) of the heat exchanger. When the heating medium for cooling is supplied to the heat transfer tubes (61) of the heat exchanger, adsorption of moisture in air in the adsorption layers is accelerated. When the heating medium for heating is supplied to the heat transfer tubes (61), desorption of moisture from the adsorption layers is accelerated. The air conditioner (10) discharges either of the air dehumidified by being taken moisture by the adsorption layers of the heat exchanger and the air humidified by receiving moisture desorbed from the adsorption layers of the heat exchanger to condition indoor air.

Effects of the Invention

According to the present invention, the corrugated sheet fins (70) shaped like a corrugated sheet are provided in the heat exchanger (60) as the fins. For this reason, by employing the corrugated sheet fins (70) each having a larger surface area than a surface area of a flat sheet fin, a heat transfer area with air in the heat exchanger (60) can be extended without making the pitch between the fins smaller. In the heat exchanger (60) according to the present invention, since the ridgeline direction of the waveform of the corrugated sheet fins (70) is substantially orthogonal to the front surface and the back surface of the heat exchanger (60), flow of the air passing through the heat exchanger (60) is hardly obstructed by the corrugated sheet fins (70). Accordingly, according to the present invention, the heat transfer area with air can be extended while suppressing an increase of ventilation resistance of the heat exchanger (60) and thus, performances of the heat exchanger (60) can be greatly improved compared with the conventional art.

Especially, according to the nineteenth and tenth aspects of the invention, the flat portions (78) are formed along the sides of the corrugated sheet fins (70). The flat portions (78) enable ensuring rigidity of the corrugated sheet fins (70). Consequently, according to the present invention, deformation of the corrugated sheet fins (70) can be prevented without making thickness of the corrugated sheet fins (70) larger.

According to the eleventh aspect of the invention, by forming the adsorption layers on the surfaces of the fins, the heat exchanger (60) has the function of adsorbing and desorbing moisture in air. According to the eleventh aspect of the invention, since the heat exchanger (60) is provided with the corrugated sheet fins (70), sufficient area of the adsorption layers can be ensured. Consequently, according to the eleventh aspect of the invention, the capability of adsorbing and desorbing moisture in the heat exchanger (60) with the adsorption layers can be improved.

According to the thirteenth and fourteenth aspects of the invention, the heat exchanger (60) according to any one of the first to ninth aspects of the invention is used as the temperature control heat exchanger (55) for processing mainly sensible heat load. That is, according to the thirteenth and fourteenth aspects of the present invention, since the high-performance heat exchanger (60) having the corrugated sheet fins (70) according to any one of the first to ninth aspects of the invention is used as the temperature control heat exchanger (55) which does not require processing of drain water, the air conditioner (10) can be reduced in size while ensuring performances of the air conditioner (10).

According to the fifteenth, sixteenth and seventeenth aspects of the invention, humidity of air is adjusted by using the heat exchanger (60) according to the eleventh or twelfth aspect of the invention. That is, according to the present invention, since the high-performance heat exchanger (60) having the corrugated sheet fin (70) according to the eleventh or twelfth aspect of the invention, the air conditioner (10) can be reduced in size while ensuring the capability of adjusting humidity of the air conditioner (10).

BRIEF DESCRIPTION OF THE DRAWINGS

FIG. 6(A) shows the first motion and FIG. 6(B) shows the second motion;

FIG. 7(A) shows the first motion and FIG. 7(B) shows the second motion;

FIG. 13(A) shows a state before assembly and FIG. 13(B) shows a state after assembly;

FIG. 15(A) shows a state before assembly and FIG. 15(B) shows a state after assembly;

FIG. 17(A) shows a state before assembly and FIG. 17(B) shows a state after assembly;

FIG. 18(A) shows a state before assembly and FIG. 18(B) shows a state after assembly;

DESCRIPTION OF REFERENCE NUMERAL

Figure 1:
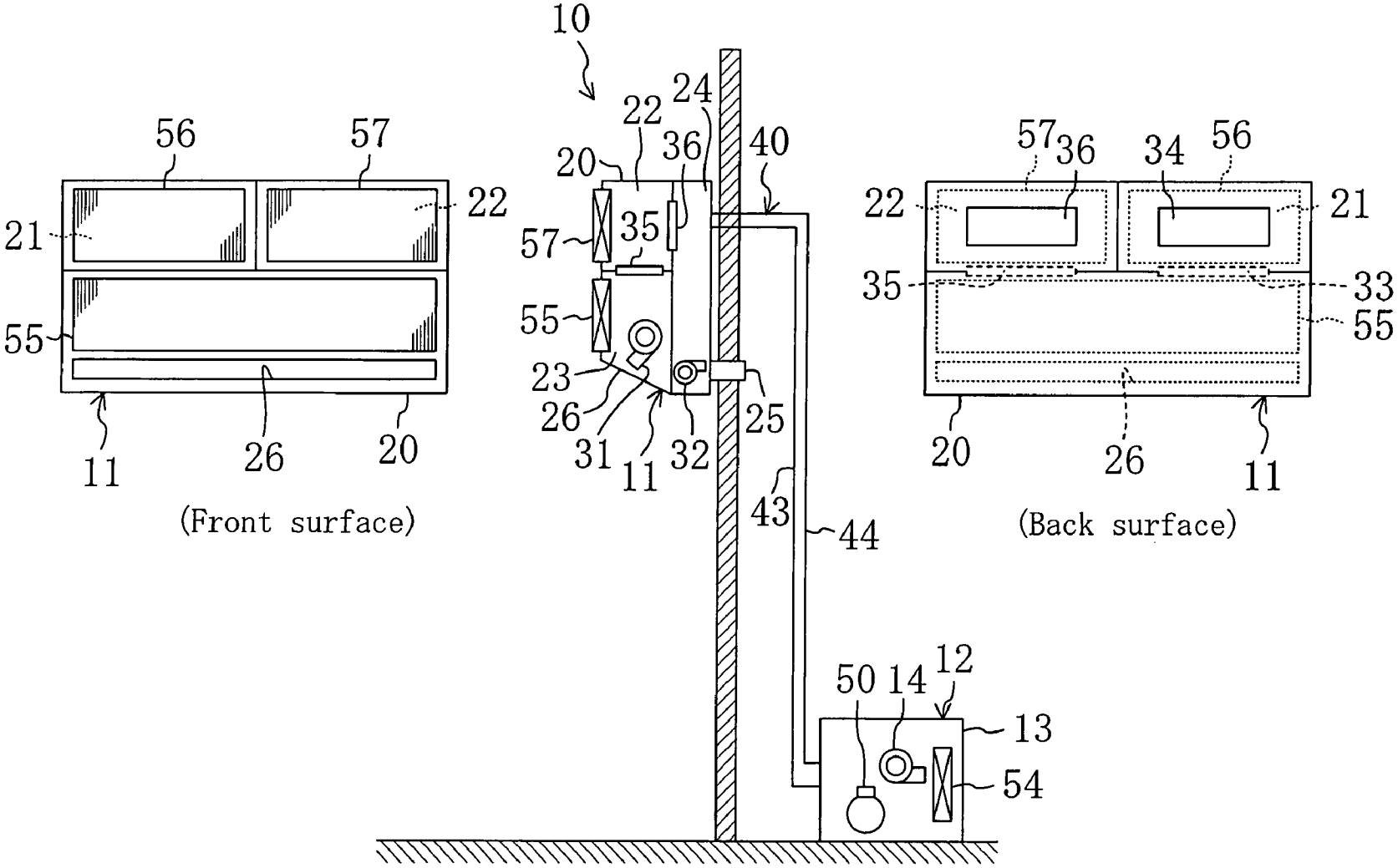
FIG. 1 is a schematic configuration view showing configuration of an air conditioner in accordance with a first embodiment.

10 Air conditioner
40 Refrigerant circuit (heating medium circuit)
55 Indoor heat exchanger (temperature control part, temperature control heat exchanger)
56 First adsorption heat exchanger (humidity control part)
57 Second adsorption heat exchanger (humidity control part)
60 Heat exchanger
61 Heat transfer tube
65 Flat sheet fin
66 Through hole
67 First collar
70 Corrugated sheet fin
75 Through hole
76 Second collar
78 Flat portion

BEST MODE FOR CARRYING OUT THE INVENTION

Embodiments of the present invention will be described in detail with reference to figures.

<<First Embodiment of the Invention>>

A first embodiment of the present invention will be described. An air conditioner (10) in this embodiment carries out a vapor compression refrigeration cycle by circulating refrigerant in a refrigerant circuit (40) as a heating medium circuit to process both indoor sensible heat load and latent heat load.

<Configuration of Air Conditioner>

As shown in FIG. 1, is a so-called separation type and has an indoor unit (11) and an outdoor unit (12). The indoor unit (11) includes an indoor heat exchanger (55), a first adsorption heat exchanger (56) and a second adsorption heat exchanger (57) and is installed indoors. The indoor unit (11) is a so-called wall-mounted type and is attached to an indoor wall surface. On the other hand, the outdoor unit (12) includes an outdoor heat exchanger (54) and is installed outdoors.

The indoor unit (11) and the outdoor unit (12) are connected to each other through a gas-side communication pipe (43) and a liquid-side communication pipe (44). A compressor (50) and an outdoor fan (14) in addition to the outdoor heat exchanger (54) are accommodated in an outdoor casing (13) of the outdoor unit (12).

The indoor unit (11) has an indoor casing (20) shaped like a horizontally long box. The indoor heat exchanger (55), the first adsorption heat exchanger (56) and the second adsorption heat exchanger (57) are disposed on the front surface of the indoor casing (20). Specifically, the first adsorption heat exchanger (56) and the second adsorption heat exchanger (57) are disposed side by side in the upper portion of the front surface of the indoor casing (20). When the indoor casing (20) is viewed from the front, the first adsorption heat exchanger (56) and the second adsorption heat exchanger (57) are installed on the left side and the right side, respectively. On the front surface of the indoor casing (20), the indoor heat exchanger (55) as a temperature control heat exchanger is located below the first adsorption heat exchanger (56) and the second adsorption heat exchanger (57) and an air outlet (26) is opened below the indoor heat exchanger (55).

An internal space of the indoor casing (20) is divided into a front surface-side space and a back surface-side space. The back surface-side space in the indoor casing (20) forms an exhaust passage (24). The front surface-side space in the indoor casing (20) is vertically partitioned. A lower space of the front surface-side space is located on the back surface side of the indoor heat exchanger (55) and forms an air supply passage (23). On the other hand, an upper space of the front surface-side space is horizontally partitioned. A left space located on the back surface side of the first adsorption heat exchanger (56) forms a first space (21) and a right space on the back surface side of the second adsorption heat exchanger (57) forms a second space (22).

An exhaust fan (32) is accommodated in the exhaust passage (24) in the indoor casing (20). An exhaust duct (25) opened outdoors is connected to the exhaust passage (24). On the other hand, an indoor fan (31) is accommodated in the air supply passage (23). The air supply passage (23) communicates to the air outlet (26).

The indoor casing (20) are provided with four openable dampers (33 to 36). Specifically, a first air supply damper (33) is provided between the first space (21) and the air supply passage (23). A first exhaust damper (34) is provided between the first space (21) and the exhaust passage (24). A second air supply damper (35) is provided between the second space (22) and the air supply passage (23). A second exhaust damper (36) is provided between the second space (22) and the exhaust passage (24).

Figure 6:
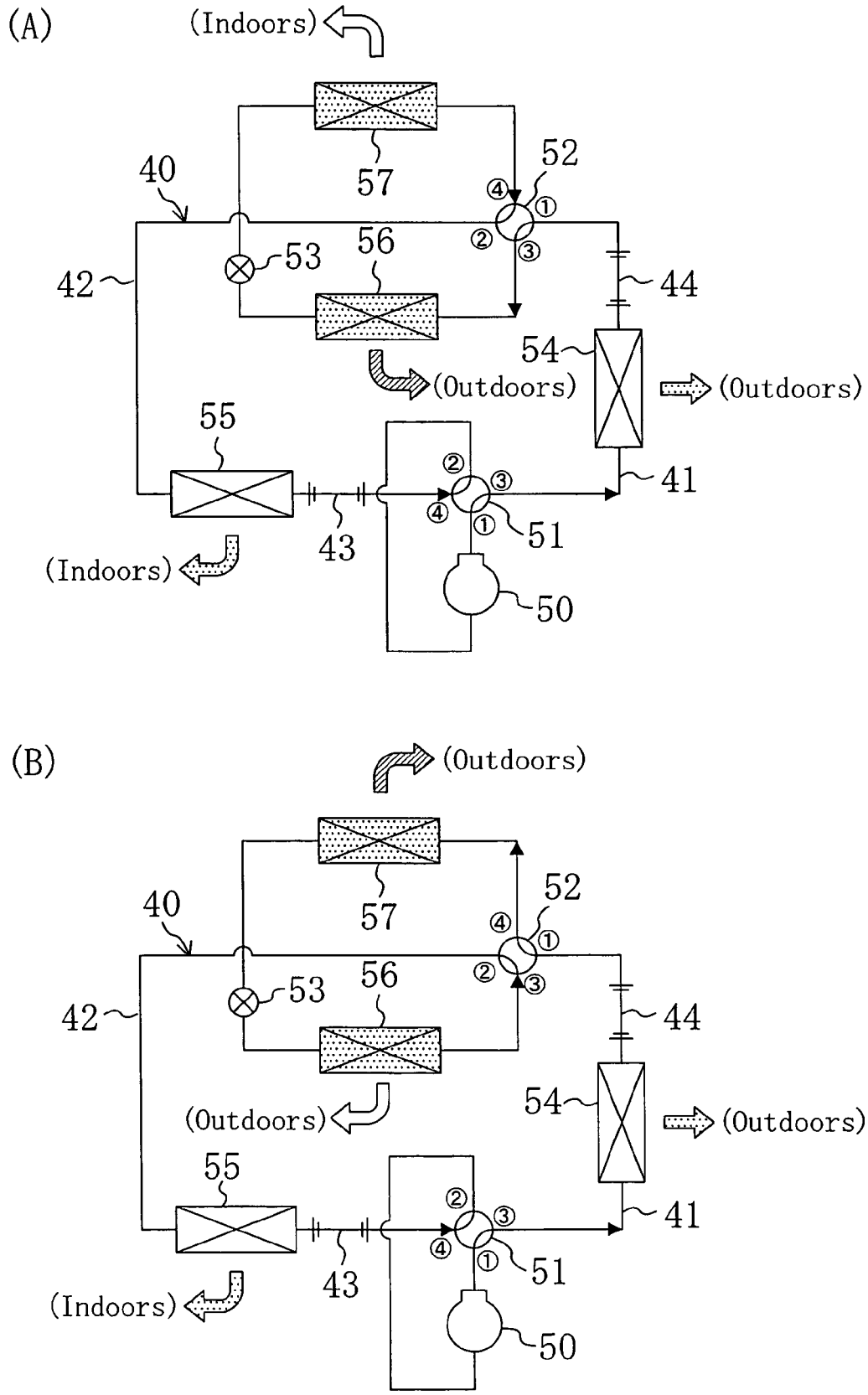
FIG. 6 is a schematic configuration view showing configuration of a refrigerant circuit and the motions during the cooling and dehumidification operation in accordance with the first embodiment.
Figure 7:
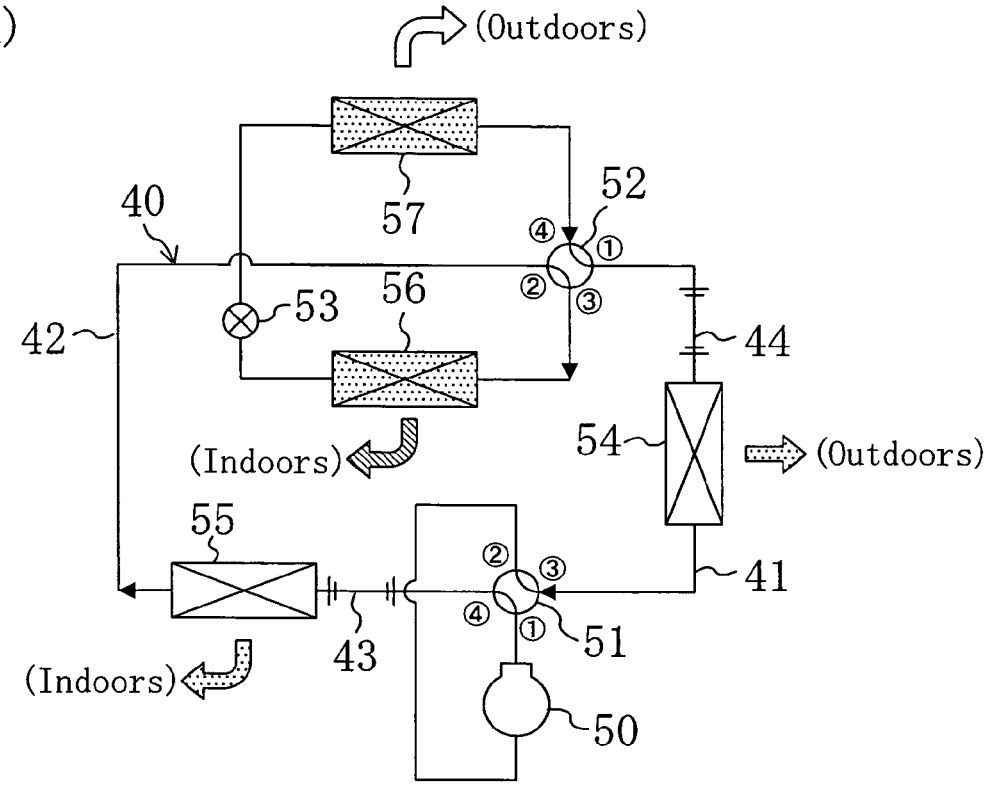
FIG. 7 is a schematic configuration view showing configuration of a refrigerant circuit and the motions during the warming and humidification operation in accordance with the first embodiment.
Figure 7:
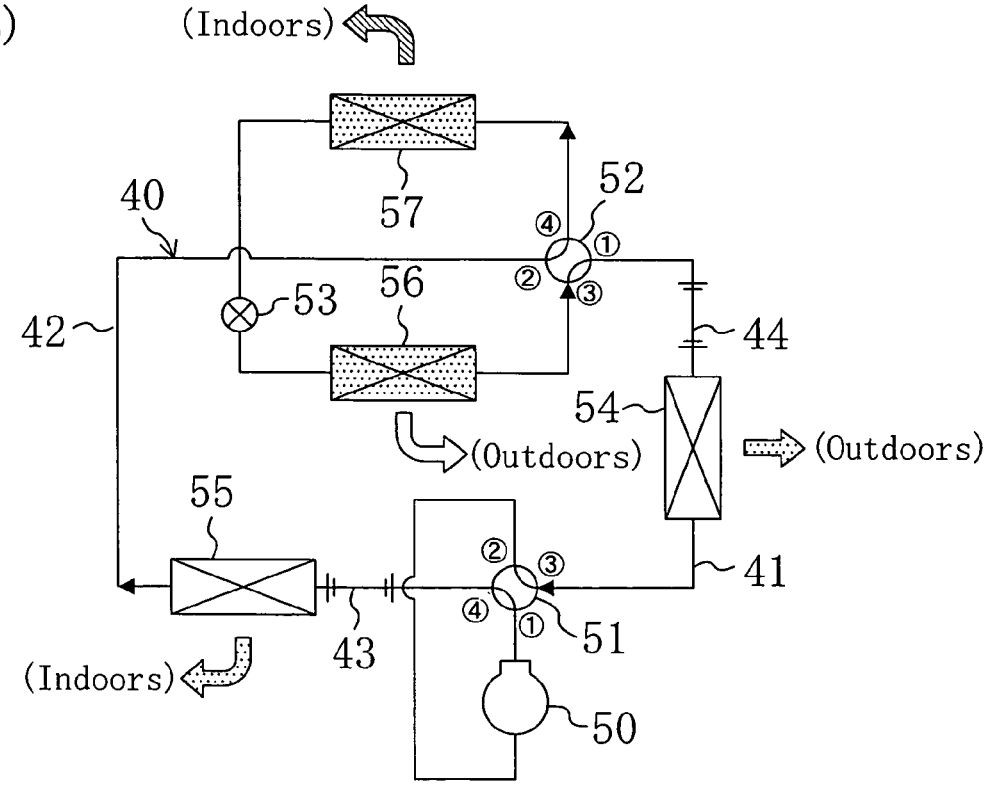

As shown in FIG. 6 and FIG. 7, the compressor (50), an electric expansion valve (53) and two four-way switching valves (51, 52) are provided in the refrigerant circuit (40). The outdoor heat exchanger (54), the indoor heat exchanger (55) and the two adsorption heat exchangers (56, 57) are also provided in the refrigerant circuit (40).

Configuration of the refrigerant circuit (40) will be described. The compressor (50) is connected to a first port of the first four-way switching valve (51) at the discharge side thereof and connected to a second port of the first four-way switching valve (51) at the suction side thereof. One end of the outdoor heat exchanger (54) is connected to a third port of the first four-way switching valve (51) and the other end of the outdoor heat exchanger (54) is connected to the first port of the second four-way switching valve (52). An end of the indoor heat exchanger (55) is connected to a fourth port of the first four-way switching valve (51) and the other end of the indoor heat exchanger (55) is connected to the second port of the second four-way switching valve (52). In the refrigerant circuit (40), the first adsorption heat exchanger (56), the electric expansion valve (53) and the second adsorption heat exchanger (57) are arranged in this order from the third port toward the fourth port of the second four-way switching valve (52).

An region of the refrigerant circuit (40) where the compressor (50), the first four-way switching valve (51) and the outdoor heat exchanger (54) are provided forms an outdoor circuit (41) and is accommodated in the outdoor unit (12). On the other hand, a region of the refrigerant circuit (40) where the indoor heat exchanger (55), the first and second adsorption heat exchangers (56, 57), the electric expansion valve (53) and the second four-way switching valve (52) are provided forms an indoor circuit (42) and is accommodated in the indoor unit (11). An end of the indoor circuit (42) on the side of the second four-way switching valve (52) is connected to an end of the outdoor circuit (41) on the side of the outdoor heat exchanger (54) through the liquid-side communication pipe (44). An end of the indoor circuit (42) on the side of the indoor heat exchanger (55) is connected to an end of the outdoor circuit (41) on the side of the first four-way switching valve (51) through the gas-side communication pipe (43).

The outdoor heat exchanger (54), the indoor heat exchanger (55) and the adsorption heat exchangers (56, 57) each are a cross fin-type fin and tube heat exchanger formed of a heat transfer tube (61) and a multiplicity of fins. The indoor heat exchanger (55) and the first and second adsorption heat exchangers (56, 57) each are formed of a heat exchanger (60) according to the present invention.

In each of the adsorption heat exchangers (56, 57), an adsorption layer made of adsorbent is formed on the surface of each fin. Zeolite, silica gel, or the like may be used as the adsorbent. In each of the adsorption heat exchangers (56, 57) in which the adsorption layer is formed on the surface of each fin, moisture is transferred between air passing between the fins and the adsorption layer. Each of the adsorption heat exchangers (56, 57) forms a humidity control part for adjusting water content in air to process indoor latent heat load.

In the outdoor heat exchanger (54) and the indoor heat exchanger (55), no adsorbent is formed on the surface of each fin and only heat exchange between air and the refrigerant is carried out. The outdoor heat exchanger (54) exchanges heat between outdoor air and the refrigerant. The indoor heat exchanger (55) exchanges heat between indoor air and the refrigerant. The heat exchanger (55) forms a temperature control part for adjusting air temperature to process indoor sensible heat load.

The first four-way switching valve (51) is switched between a first state where the first port and the third port are communicated to each other and the second port and the fourth port are communicated to each other (state shown in FIG. 6) and a second state where the first port and the fourth port are communicated to each other and the second port and the third port are communicated to each other (state shown in FIG. 7). On the other hand, the second four-way switching valve (52) is switched between the first state where the first port and the third port are communicated to each other and the second port and the fourth port are communicated to each other (state shown in FIG. 6(A) and FIG. 7(B)) and the second state where the first port and the fourth port are communicated to each other and the second port and the third port are communicated to each other (state shown in FIG. 6(B) and FIG. 7(A)).

<Configuration of Heat Exchanger>

As described above, the indoor heat exchanger (55), the first adsorption heat exchanger (56) and the second adsorption heat exchanger (57) each are formed of the heat exchanger (60) according to the present invention. Hereinafter, the heat exchanger (60) will be described with reference to FIG. 8 and FIG. 9.

Figure 8:
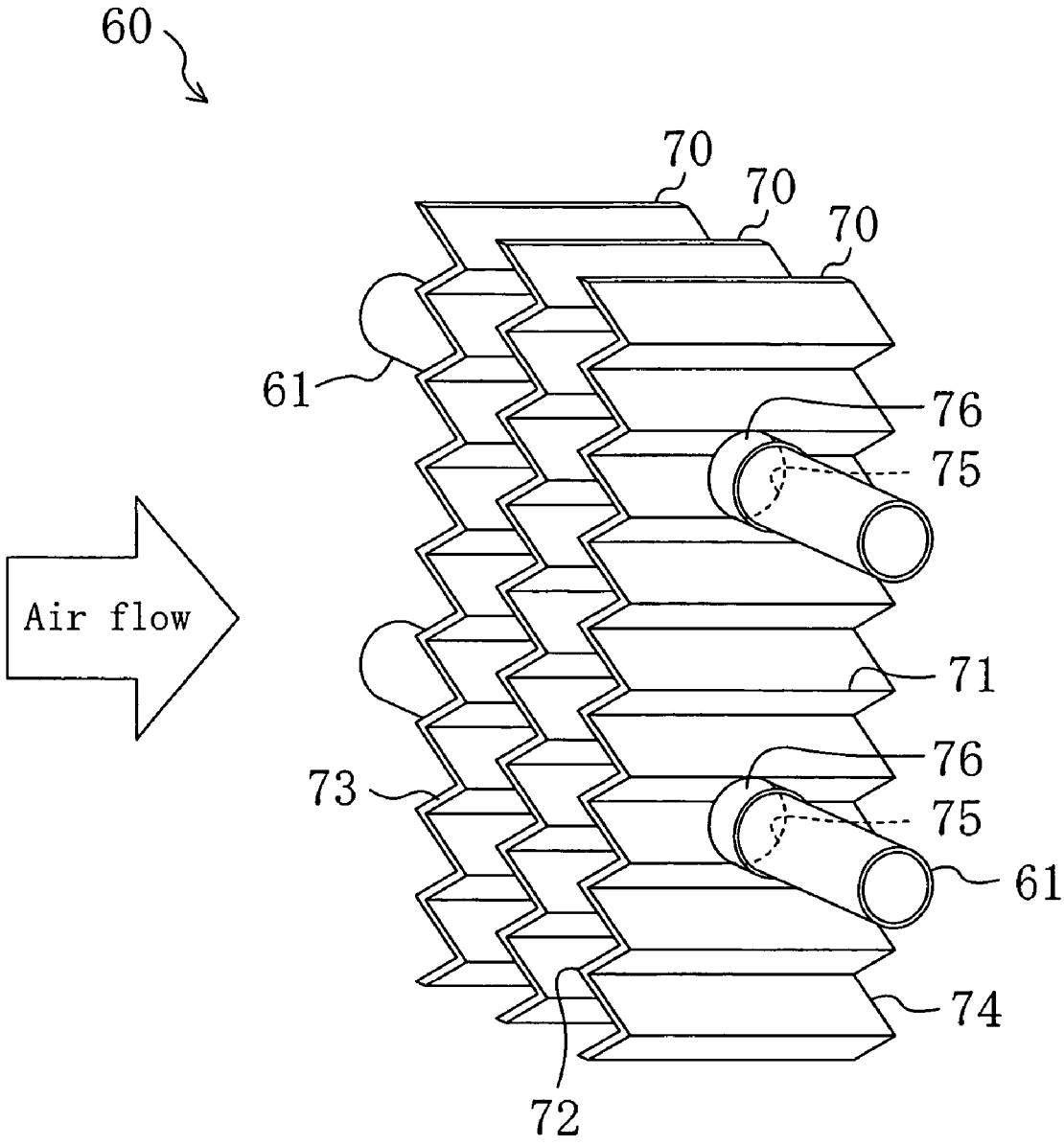
FIG. 8 is a perspective view showing schematic configuration of a heat exchanger in accordance with the first embodiment.

As shown in FIG. 8, the heat exchanger (60) has a plurality of straight heat transfer tubes (61) and corrugated sheet-like corrugated sheet fins (70). The heat exchanger (60) is shaped like a thick plate or a flat rectangular parallelepiped as a whole. In the heat exchanger (60), air passes from the front surface toward the back surface.

In the heat exchanger (60), the heat transfer tubes (61) are arranged in an almost horizontal position at regular intervals. In the heat exchanger (60), ends of the adjacent heat transfer tubes (61) are connected to each other with a U-like tube, not shown, to form one or more paths.

On the other hand, the corrugated sheet fins (70) are arranged in the axial direction of the heat transfer tubes (61) at regular pitches so that the fin surfaces may be orthogonal to the axial direction of the heat transfer tubes (61). Each corrugated sheet fin (70) is shaped like a corrugated sheet in which peaks (71) and troughs (72) are alternatively formed on a constant cycle. That is, the waveform of the corrugated sheet fin (70) is a triangle wave and the peaks (71) and the troughs (72) are alternately formed in a constant cycle in the vertical direction in FIG. 8. Here, a portion protruded toward the near side on the right is defined as the peak (71) and a portion protruded toward the back side on the left is defined as the trough (72) in this figure.

In each of the corrugated sheet fins (70), a side surface located in the upstream side of air flow is defined as a front edge (73) and a side surface located in the downstream side of air flow is defined as a rear edge (74). That is, in the corrugated sheet fins (70), the front edges (73) are located on the side of the front surface of the heat exchanger (60) and the rear edges (74) are located on the side of the back surface of the heat exchanger (60).

Through holes (75) for inserting the heat transfer tubes (61) therethrough are formed on the corrugated sheet fins (70). Cylindrical collars (76) which are continuous with the peripheries of the through holes (75) are protrudingly provided on the corrugated sheet fins (70). In FIG. 8, the collars (76) protrude from the surfaces of the corrugated sheet fins (70) toward the near side on the right. The heat transfer tubes (61) are inserted into the collars (76), respectively, and the inner circumferential surfaces of the collars (76) are in close contact with the outer circumferential surfaces of the heat transfer tubes (61). Protruding ends of the collars (76) come into contact with the adjacent corrugated sheet fin (70), thereby maintaining a distance between the corrugated sheet fins (70).

In the heat exchanger (60) thus configured, an amplitude direction of the waveform of the corrugated sheet fins (70) is substantially parallel to the axial direction of the heat transfer tube (61). A ridgeline direction of the waveform of the corrugated sheet fins (70) is orthogonal to the front edges (73) and the rear edges (74) of the corrugated sheet fins (70).

Figure 9:
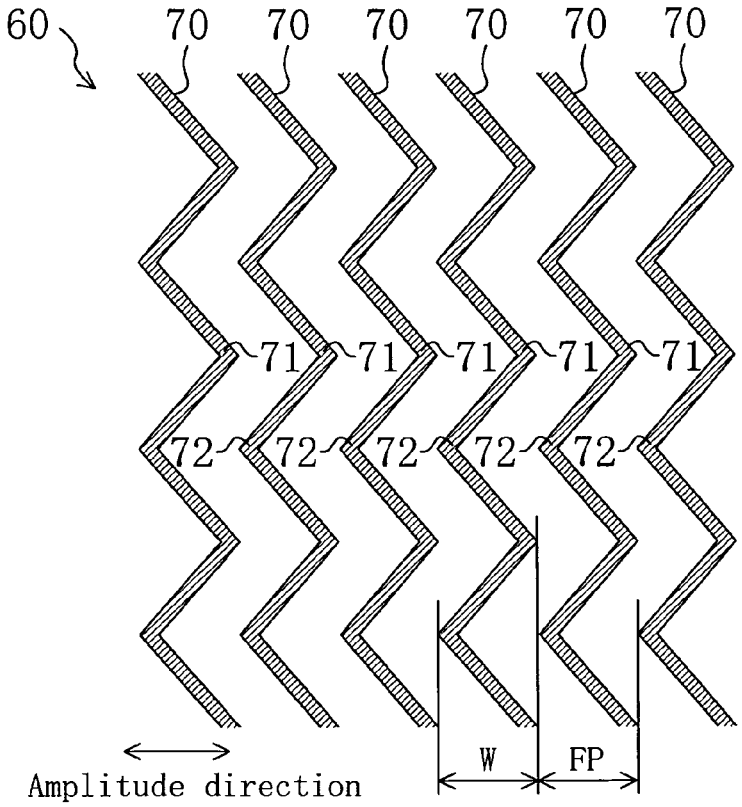
FIG. 9 is an enlarged view of a main part of the heat exchanger which shows arrangement of corrugated sheet fins in accordance with the first embodiment.

In the heat exchanger (60), as shown in FIG. 9, the cycle of the waveform is identical throughout the adjacent corrugated sheet fins (70). In the heat exchanger (60), an amplitude W of the waveform of the corrugated sheet fin (70) is equal to a pitch FP between the corrugated sheet fins (70). In the heat exchanger (60), air passing between the corrugated sheet fins (70) arranged at regular pitches exchanges heat with the refrigerant flowing through the heat transfer tubes (61) provided so as to pass through the corrugated sheet fins (70).

In the heat exchangers (60) used as the first and second adsorption heat exchangers (56, 57), the adsorption layers are formed on the surfaces of the corrugated sheet fins (70). In the heat exchangers (60) used as the first and second adsorption heat exchangers (56, 57), air passing between the corrugated sheet fins (70) arranged at regular pitches exchanges heat with the refrigerant flowing through the heat transfer tubes (61) provided so as to pass through the corrugated sheet fins (70) and come into contact with the adsorption layers formed on the surfaces of the corrugated sheet fins (70).

On the other hand, in the heat exchanger (60) used as the indoor heat exchanger (55), no adsorption layer is formed on the surfaces of the corrugated sheet fins (70). In the heat exchanger (60) used as the indoor heat exchanger (55), air passing between the corrugated sheet fins (70) arranged at regular pitches exchanges heat with the refrigerant flowing through the heat transfer tubes (61) provided so as to pass through the corrugated sheet fins (70).

-Operational Behavior-

The air conditioner (10) in this embodiment performs a cooling and dehumidification operation and a warming and humidification operation.

In the air conditioner (10), when the indoor fan (31) and the exhaust fan (32) are operated, indoor air flows into each of the indoor heat exchanger (55), the first adsorption heat exchanger (56) and the second adsorption heat exchanger (57). When the outdoor fan (14) is operated, outdoor air flows into the outdoor heat exchanger (54).

<Cooling and Dehumidification Operation>

Motions of the cooling and dehumidification operation will be described with reference to FIG. 2, FIG. 3 and FIG. 6.

As shown in FIG. 6, in the refrigerant circuit (40), the first four-way switching valve (51) is set at the first state, degree of opening of the electric expansion valve (53) is appropriately adjusted, the outdoor heat exchanger (54) serves as a condenser and the indoor heat exchanger (55) serves as an evaporator. Then, as shown in FIG. 2 and FIG. 3, the indoor air cooled by the indoor heat exchanger (55) passes through the air supply passage (23) and is sent back indoors through the air outlet (26), while the outdoor air which absorbs heat from the refrigerant in the outdoor heat exchanger (54) is discharged outdoors.

During the cooling and dehumidification operation, a first motion in which the first adsorption heat exchanger (56) serves as the condenser and the second adsorption heat exchanger (57) serves as the evaporator and a second motion in which the second adsorption heat exchanger (57) serves as the condenser and the first adsorption heat exchanger (56) serves as the evaporator are alternately repeated.

In the first motion, a regeneration motion of the first adsorption heat exchanger (56) and an adsorption motion of the second adsorption heat exchanger (57) are carried out in parallel. As shown in FIG. 6(A), during the first motion, the second four-way switching valve (52) is set at the first state. The refrigerant discharged from the compressor (50) is condensed during passage through the outdoor heat exchanger (54) and the first adsorption heat exchanger (56) in this order and decompressed by the electric expansion valve (53). Then, the refrigerant is evaporated during passage through the second adsorption heat exchanger (57) and the indoor heat exchanger (55) in this order, sucked into the compressor (50) and compressed. In the first motion, high-pressure refrigerant as a heating medium for heating is supplied to the first adsorption heat exchanger (56) and low-pressure refrigerant as a heating medium for cooling is supplied to the second adsorption heat exchanger (57).

Figure 2:
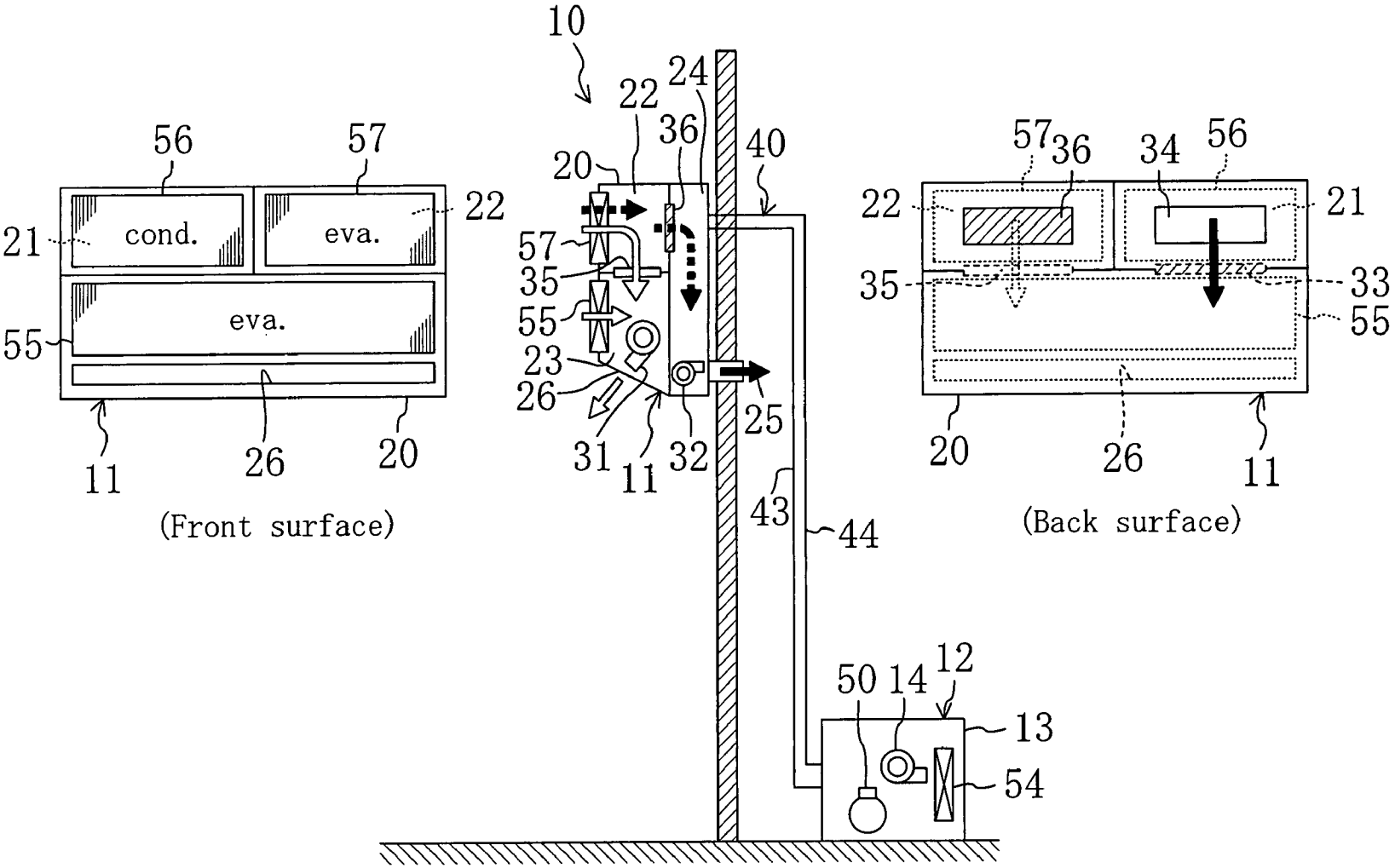
FIG. 2 is a schematic configuration view showing a first motion during a cooling and dehumidification operation in the air conditioner in accordance with the first embodiment.

In the first motion, as shown in FIG. 2, the first exhaust damper (34) and the second air supply damper (35) are put into an open state and the first air supply damper (33) and the second exhaust damper (36) are put into a closed state. In the first adsorption heat exchanger (56), moisture is desorbed from an adsorbent heated by the refrigerant and the desorbed moisture is given to air. Together with indoor air, the moisture desorbed from the first adsorption heat exchanger (56) flows into the exhaust passage (24) from the first space (21) through the first exhaust damper (34) and is discharged outdoors through the exhaust duct (25). In the second adsorption heat exchanger (57), moisture in indoor air is adsorbed by the adsorbent, the indoor air is dehumidified and adsorption heat generated at this time is absorbed by the refrigerant. The indoor air dehumidified by the second adsorption heat exchanger (57) flows into the air supply passage (23) from the second space (22) through the second air supply damper (35) and is sent back indoors through the air outlet (26).

In the second motion, the adsorption motion of the first adsorption heat exchanger (56) and the regeneration motion of the second adsorption heat exchanger (57) are carried out in parallel. In the second motion, as shown in FIG. 6(B), the second four-way switching valve (52) is set at the second state. In this state, the refrigerant discharged from the compressor (50) is condensed during passage through the outdoor heat exchanger (54) and the second adsorption heat exchanger (57) in this order and decompressed by the electric expansion valve (53). Then, the refrigerant is evaporated during passage through the first adsorption heat exchanger (56) and the indoor heat exchanger (55) in this order, sucked into the compressor (50) and compressed. In the second motion, the high-pressure refrigerant as the heating medium for heating is supplied to the second adsorption heat exchanger (57) and the low-pressure refrigerant as the heating medium for cooling is supplied to the first adsorption heat exchanger (56).

Figure 3:
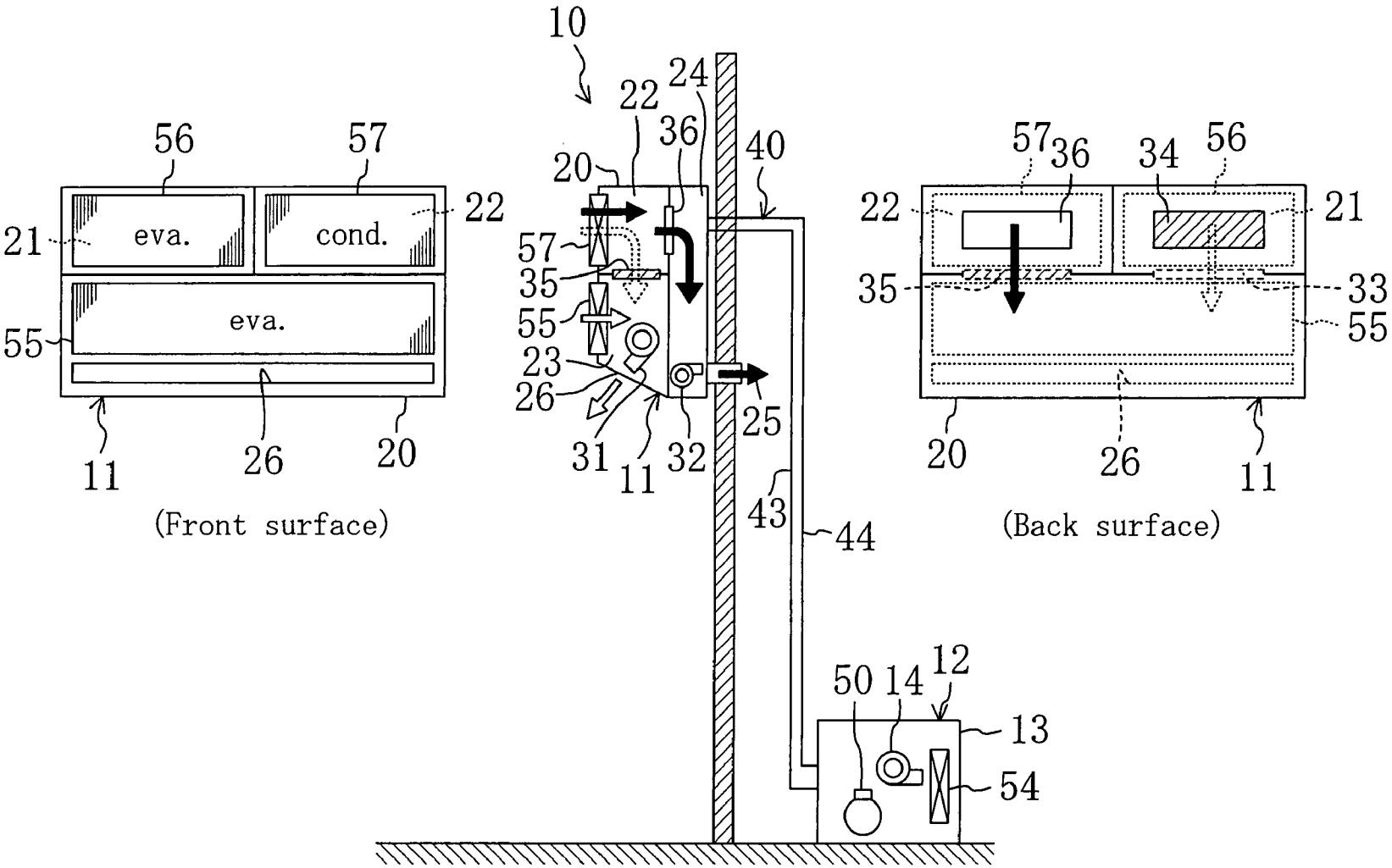
FIG. 3 is a schematic configuration view showing a second motion during the cooling and dehumidification operation in the air conditioner in accordance with the first embodiment.

In the second motion, as shown in FIG. 3, the first air supply damper (33) and the second exhaust damper (36) are put into the open state and the first exhaust damper (34) and the second air supply damper (35) are put into the closed state. In the first adsorption heat exchanger (56), moisture in indoor air is adsorbed by the adsorbent, the indoor air is dehumidified and adsorption heat generated at this time is adsorbed by the refrigerant. The indoor air dehumidified in the first adsorption heat exchanger (56) flows into the air supply passage (23) from the first space (21) through the first air supply damper (33) and is sent back indoors through the air outlet (26). In the second adsorption heat exchanger (57), moisture is desorbed from the adsorbent heated by the refrigerant and the desorbed moisture is given to air. Together with the indoor air, the moisture desorbed from the second adsorption heat exchanger (57) flows into the exhaust passage (24) from the second space (22) through the second exhaust damper (36) and is discharged outdoors through the exhaust duct (25).

Here, in a general air conditioner without the adsorption heat exchangers (56, 57), evaporation temperature of the refrigerant in the indoor heat exchanger during the cooling operation is set as a value lower than dew point temperature of the indoor air (for example, about 5° C.). This is for the purpose of dehumidifying the indoor air by condensing the moisture in the indoor air by the indoor heat exchanger.

On the contrary, during the cooling and dehumidification operation of the air conditioner (10) in this embodiment, since the indoor air is dehumidified by the adsorption heat exchangers (56, 57), the indoor air need not be dehumidified by the indoor heat exchanger (55). Thus, in the air conditioner (10), evaporation temperature of the refrigerant in the indoor heat exchanger (55) during the cooling and dehumidification operation is set as a higher value than that in a general air conditioner. Specifically, evaporation temperature of the refrigerant in the indoor heat exchanger (55) during the cooling and dehumidification operation is set to be higher than dew point temperature of the air passing through the indoor heat exchanger (55). For this reason, in the indoor heat exchanger (55), no drain water is generated even during the cooling and dehumidification operation.

During the cooling and dehumidification operation of the air conditioner (10) in this embodiment, in the first motion, the second adsorption heat exchanger (57) serves as the evaporator, and in the second motion, the first adsorption heat exchanger (56) serves as the evaporator. In the adsorption heat exchangers (56, 57) used as the evaporators, moisture in the indoor air passing between the corrugated sheet fins (70) is adsorbed by the adsorption layer, the adsorption heat generated at this time is adsorbed and the refrigerant in the heat transfer tubes (61) is evaporated. That is, temperature in the adsorption heat exchangers (56, 57) used as the evaporators is not lowered so much, while absolute humidity of the indoor air passing through the adsorption heat exchangers is lowered. For this reason, water condensation is hardly generated on the surfaces of the corrugated sheet fins (70) of the adsorption heat exchangers (56, 57) used as the evaporators.

<Warming and Humidification Operation>

Motions in the warming and humidification operation will be described with reference to FIG. 4, FIG. 5 and FIG. 7.

As shown in FIG. 7, in the refrigerant circuit (40), the first four-way switching valve (51) is set at the second state, degree of opening of the electric expansion valve (53) is appropriately adjusted, the indoor heat exchanger (55) serves as a condenser and the outdoor heat exchanger (54) serves as an evaporator. Then, as shown in FIG. 4 and FIG. 5, the indoor air heated by the indoor heat exchanger (55) passes through the air supply passage (23) and is sent back indoors through the air outlet (26), while the outdoor air which discharges heat to the refrigerant in the outdoor heat exchanger (54) is discharged outdoors.

During the warming and humidification operation, a first motion in which the first adsorption heat exchanger (56) serves as the condenser and the second adsorption heat exchanger (57) serves as the evaporator and a second motion in which the second adsorption heat exchanger (57) serves as the condenser and the first adsorption heat exchanger (56) serves as the evaporator are alternately repeated.

In the first motion, the adsorption motion of the first adsorption heat exchanger (56) and the regeneration motion of the second adsorption heat exchanger (57) are carried out in parallel. In the first motion, as shown in FIG. 7(A), the second four-way switching valve (52) is set at the second state. In this state, the refrigerant discharged from the compressor (50) is condensed during passage through the indoor heat exchanger (55) and the first adsorption heat exchanger (56) in this order and decompressed by the electric expansion valve (53). Then, the refrigerant is evaporated during passage through the second adsorption heat exchanger (57) and the outdoor heat exchanger (54) in this order, sucked into the compressor (50) and compressed. In the first motion, the high-pressure refrigerant as the heating medium for heating is supplied to the first adsorption heat exchanger (56) and the low-pressure refrigerant as the heating medium for cooling is supplied to the second adsorption heat exchanger (57).

Figure 4:
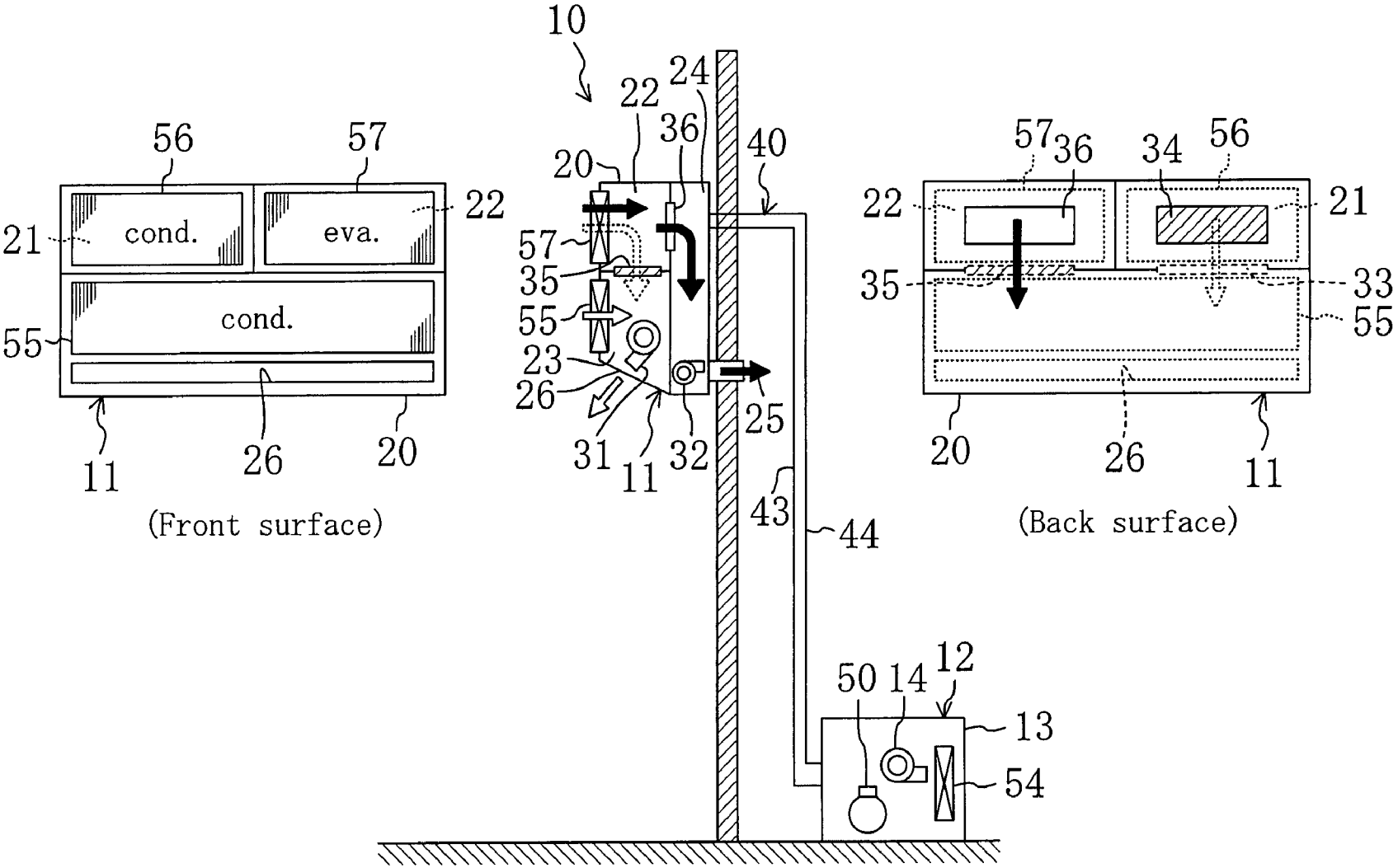
FIG. 4 is a schematic configuration view showing a first motion during a warming and humidification operation in the air conditioner in accordance with the first embodiment.

In the first motion, as shown in FIG. 4, the first air supply damper (33) and the second exhaust damper (36) are put into the open state and the first exhaust damper (34) and the second air supply damper (35) are put into the closed state. In the first adsorption heat exchanger (56), moisture is desorbed from an adsorbent heated by the refrigerant and the desorbed moisture is given to air. The indoor air dehumidified in the first adsorption heat exchanger (56) flows into the air supply passage (23) from the first space (21) through the first air supply damper (33) and is sent back indoors through the air outlet (26). In the second adsorption heat exchanger (57), moisture in indoor air is adsorbed by the adsorbent, the indoor air is dehumidified and adsorption heat generated at this time is adsorbed by the refrigerant. The indoor air from which moisture is taken in the second adsorption heat exchanger (57) flows into the exhaust passage (24) from the second space (22) through the second exhaust damper (36) and is discharged outdoors through the exhaust duct (25).

In the second motion, the adsorption motion of the first adsorption heat exchanger (56) and the regeneration motion of the second adsorption heat exchanger (57) are carried out in parallel. In the second motion, as shown in FIG. 7(B), the second four-way switching valve (52) is set at the first state. In this state, the refrigerant discharged from the compressor (50) is condensed during passage through the indoor heat exchanger (55) and the second adsorption heat exchanger (57) in this order and successively decompressed by the electric expansion valve (53). Then, the refrigerant is evaporated during passage through the first adsorption heat exchanger (56) and the outdoor heat exchanger (54) in this order, sucked into the compressor (50) and compressed. In the second motion, the high-pressure refrigerant as the heating medium for heating is supplied to the second adsorption heat exchanger (57) and the low-pressure refrigerant as the heating medium for cooling is supplied to the first adsorption heat exchanger (56).

Figure 5:
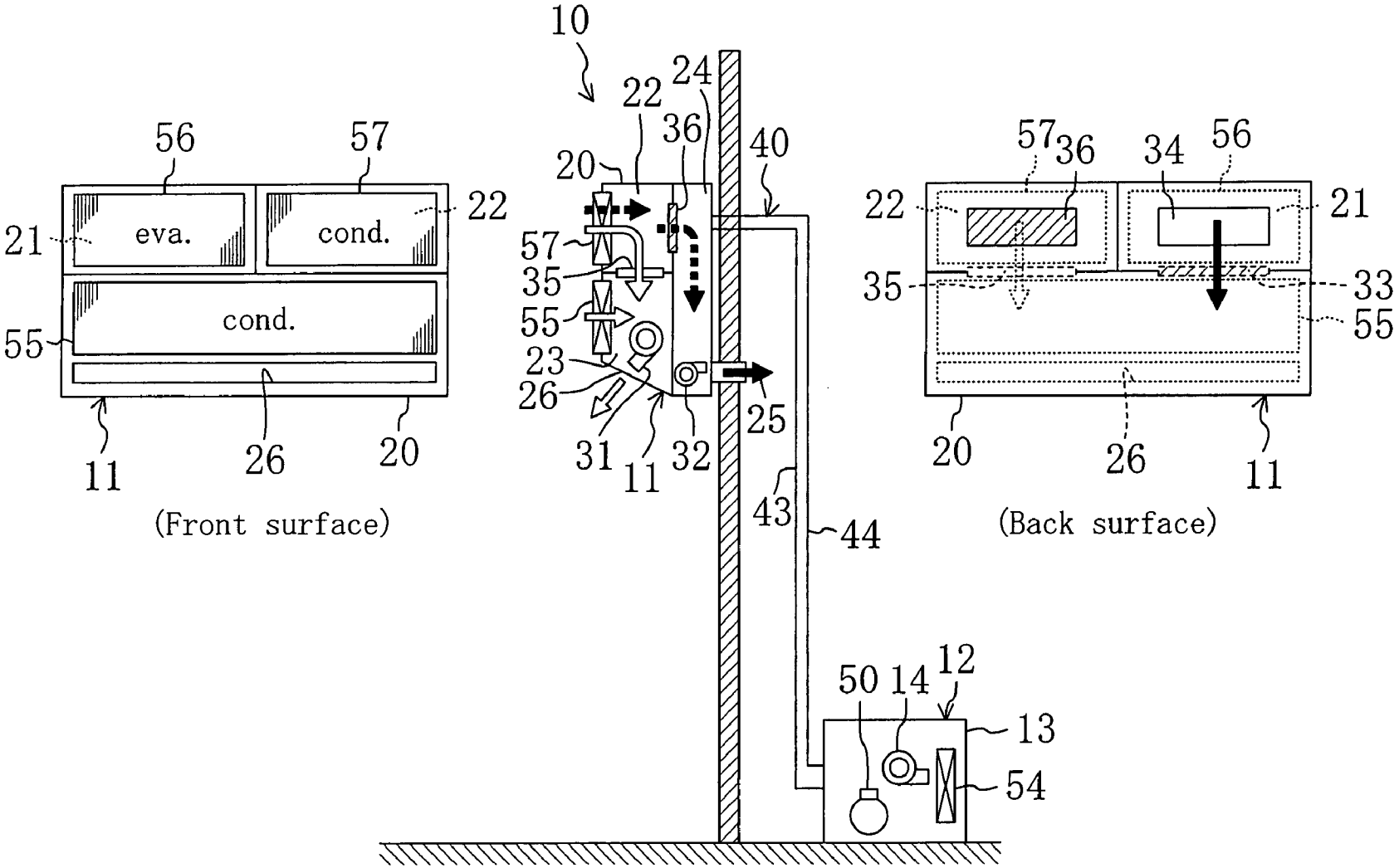
FIG. 5 is a schematic configuration view showing a second motion during the warming and humidification operation in the air conditioner in accordance with the first embodiment.

In the second motion, as shown in FIG. 5, the first exhaust damper (34) and the second air supply damper (35) are put into the open state and the first air supply damper (33) and the second exhaust damper (36) are put into the closed state. In the first adsorption heat exchanger (56), moisture in indoor air is adsorbed by the adsorbent, the indoor air is dehumidified and adsorption heat generated at this time is adsorbed by the refrigerant. The indoor air dehumidified in the first adsorption heat exchanger (56) flows into the exhaust passage (24) from the first space (21) through the first exhaust damper (34) and is discharged outdoors through the exhaust duct (25). In the second adsorption heat exchanger (57), moisture is desorbed from the adsorbent heated by the refrigerant and the desorbed moisture is given to the indoor air. The indoor air humidified in the second adsorption heat exchanger (57) flows into the air supply passage (23) from the second space (22) through the second air supply damper (35) and is sent back indoors through the air outlet (26).

During the warming and humidification operation of the air conditioner (10) in this embodiment, in the first motion, the second adsorption heat exchanger (57) serves as the evaporator and in the second motion, the first adsorption heat exchanger (56) serves as the evaporator. Also during the warming and humidification operation, in the adsorption heat exchangers (56, 57) used as the evaporators, moisture in the indoor air passing between the corrugated sheet fins (70) is adsorbed by the adsorption layer, the adsorption heat generated at this time is adsorbed and the refrigerant in the heat transfer tubes (61) is evaporated. Thus, similarly to the cooling and dehumidification operation, during the warming and humidification operation, water condensation is hardly generated on the surfaces of the corrugated sheet fins (70) of the adsorption heat exchangers (56, 57) used as the evaporators.

-Effects of First Embodiment-

In this embodiment, the heat exchanger (60) having the corrugated sheet fin (70) is adopted as the indoor heat exchanger (55) and the adsorption heat exchangers (56, 57). Since the heat exchanger (60) employs the corrugated sheet fins (70) each having a larger surface area than a surface area of a flat sheet fin, a heat transfer area with air in the heat exchanger (60) can be extended without making the pitch between the fins smaller. In the heat exchanger (60), the corrugated sheet fins (70) are arranged so that the ridgeline direction of the waveform of the corrugated sheet fins (70) may be orthogonal to the front surface and the back surface of the heat exchanger (60). For this reason, the flow of air passing through the heat exchanger (60) is not obstructed by the corrugated sheet fins (70) and thus, air smoothly passes from the front surface toward the back surface of the heat exchanger (60). Accordingly, by adopting the heat exchanger (60) as the indoor heat exchanger (55) and the adsorption heat exchangers (56, 57), the heat transfer area on the side of air can be extended while suppressing an increase in ventilation resistance in the indoor heat exchanger (55) and the adsorption heat exchangers (56, 57), and the indoor heat exchanger (55) and the adsorption heat exchangers (56, 57) can be greatly reduced in size.

Here, in the heat exchanger (60), when moisture in air is condensed on the corrugated sheet fins (70), it cannot be said there is no possibility that the generated condensed water (drain water) is hard to run off. On the contrary, in the air conditioner (10) in this embodiment, even in any of the indoor heat exchanger (55) and the adsorption heat exchanger (56, 57) which are used as the evaporator, moisture in air is hardly condensed or is not condensed at all on the surfaces of the corrugated sheet fins (70). Thus, the heat exchanger (60) having the corrugated sheet fins (70) is extremely suitable as the indoor heat exchanger (55) and the adsorption heat exchangers (56, 57) of the air conditioner (10), and by adopting the heat exchanger (60), the indoor unit (11) can be reduced in size.

-Modification Example of First Embodiment-

Figure 10:
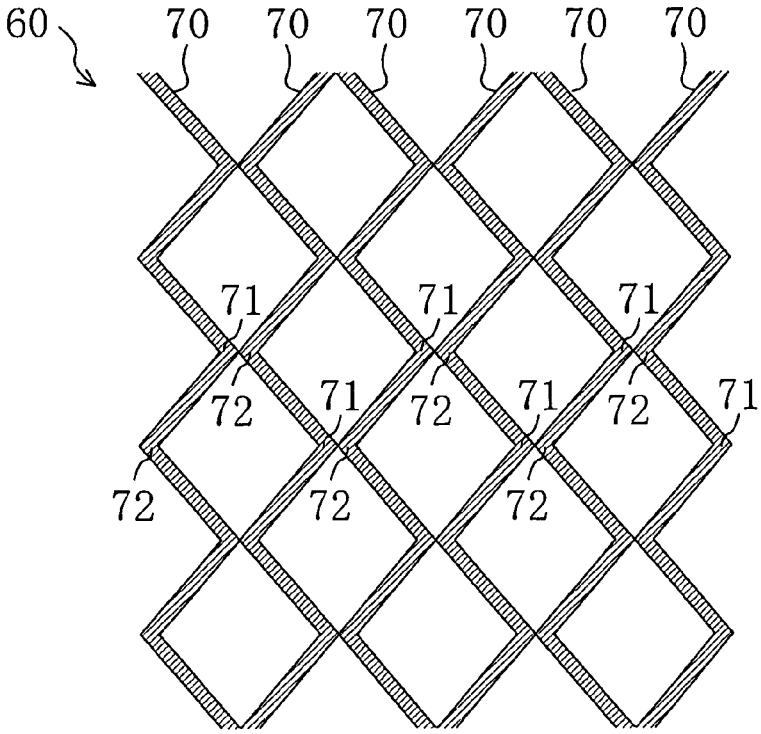
FIG. 10 is an enlarged view of a main part of a heat exchanger which shows arrangement of corrugated sheet fins in accordance with a modification example of the first embodiment.

In the heat exchanger (60) adopted as the indoor heat exchanger (55) and the adsorption heat exchangers (56, 57) in this embodiment, the cycle of the waveform of the adjacent corrugated sheet fins (70) need not be the same. For example, as shown in FIG. 10, the waveforms of the adjacent corrugated sheet fins (70) may be shifted by half cycle. In this case, in the heat exchanger (60), the peaks (71) and the troughs (72) of the adjacent corrugated sheet fins (70) are in contact with each other and air passes through space having a rectangular cross section surrounded by the adjacent corrugated sheet fins (70).

<<Second Embodiment of the Invention>>

A second embodiment of the present invention will be described. In this embodiment, in the air conditioner (10) in the first embodiment, configuration of the heat exchanger (60) adopted as the indoor heat exchanger (55) and the adsorption heat exchangers (56, 57) is modified. Here, configuration of this heat exchanger (60) will be described.

Figure 11:
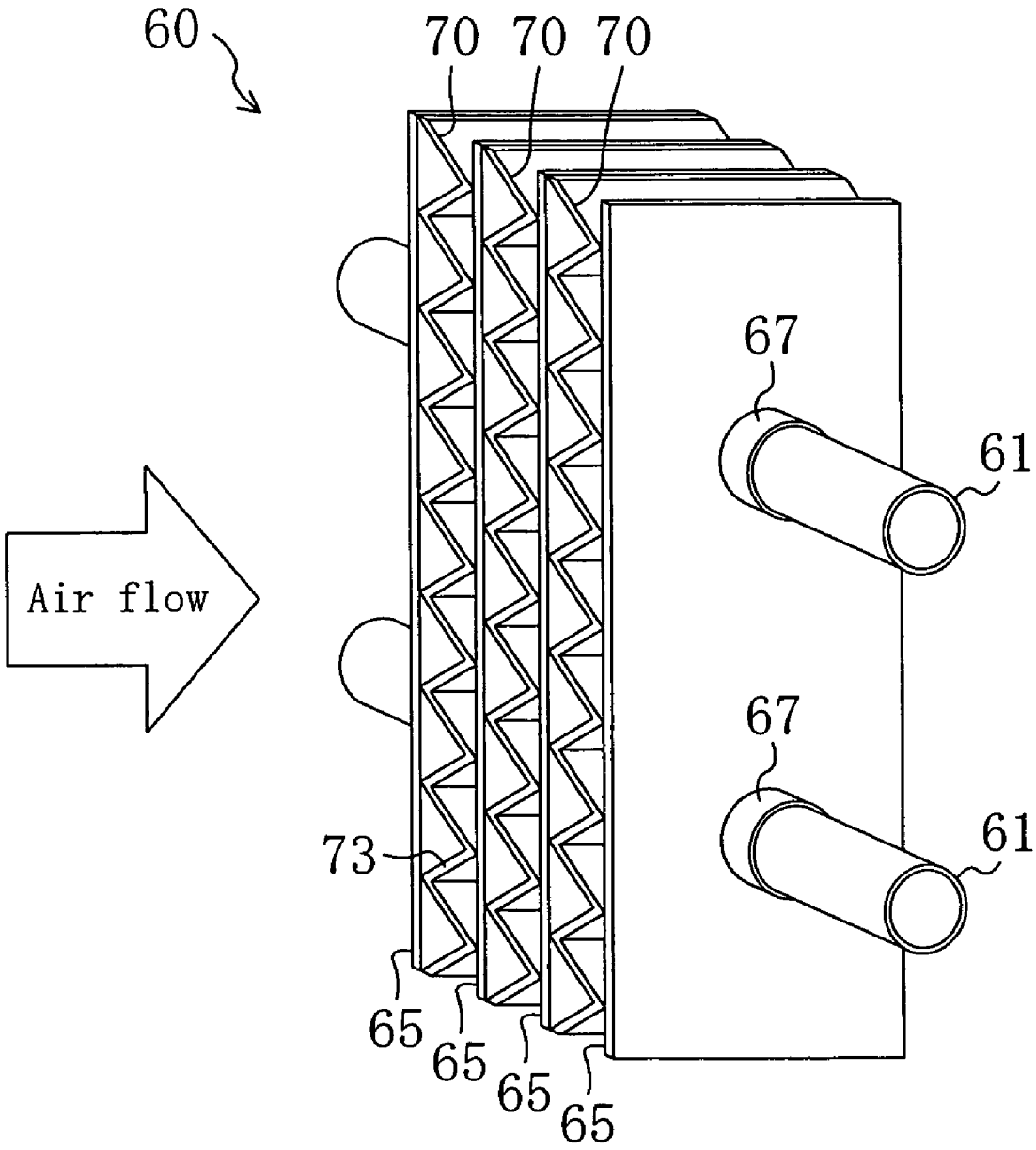
FIG. 11 is a perspective view showing schematic configuration of a heat exchanger in accordance with a second embodiment.
Figure 12:
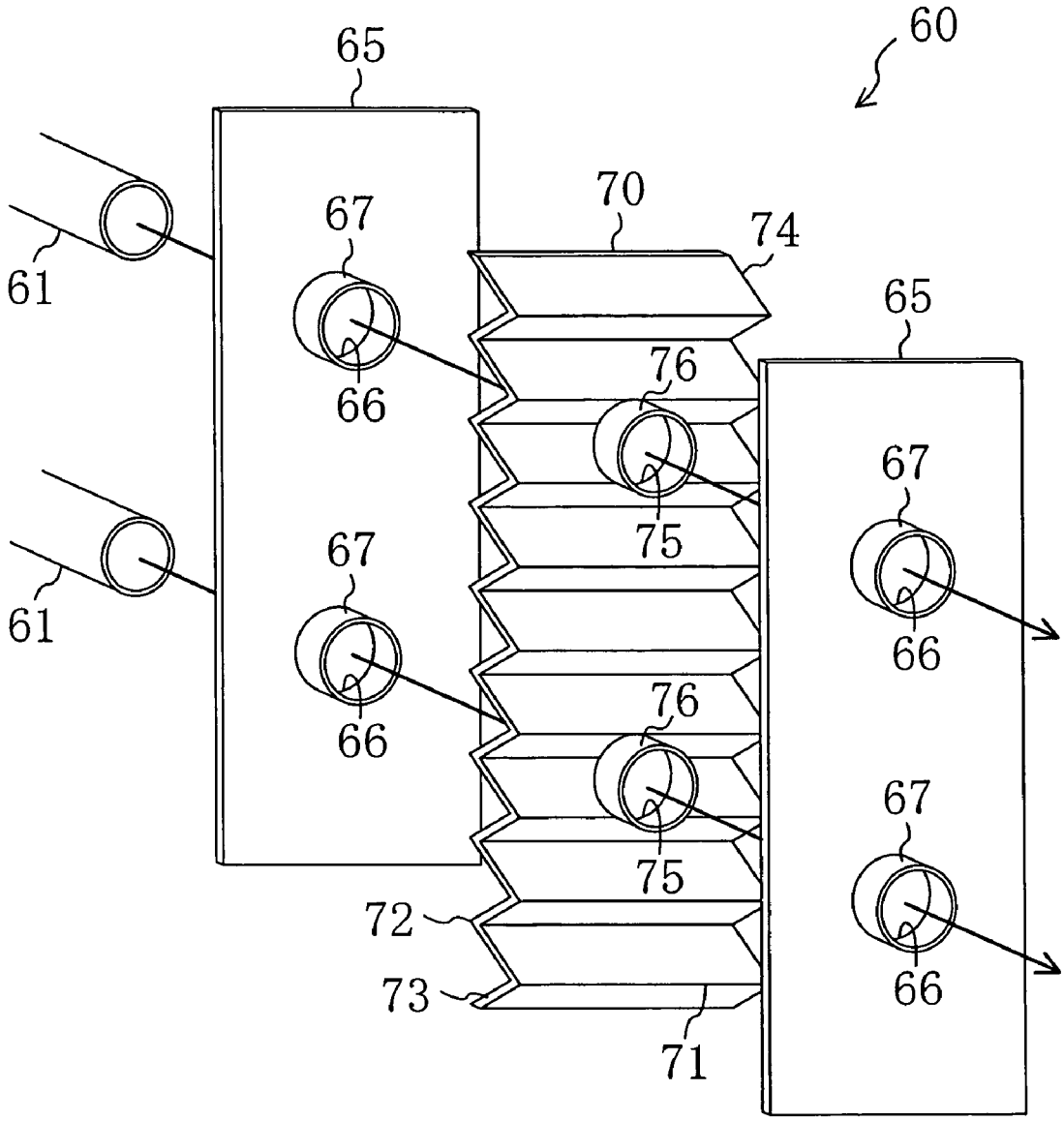
FIG. 12 is an exploded perspective view showing schematic configuration of the heat exchanger in accordance with the second embodiment.

As shown in FIG. 11 and FIG. 12, the heat exchanger (60) in this embodiment has a plurality of straight heat transfer tubes (61), flat sheet-like flat sheet fins (65) and corrugated sheet-like corrugated sheet fins (70). The heat exchanger (60) is shaped like a thick plate or a flat rectangular parallelepiped as a whole. In the heat exchanger (60), air passes from the front surface toward the back surface.

In the heat exchanger (60), the heat transfer tubes (61) are horizontally arranged at regular intervals. In the heat exchanger (60), ends of the adjacent heat transfer tubes (61)

are connected to each other with a U-like tube, not shown, to form one or more paths. The flat sheet fins (65) and the corrugated sheet fins (70) are alternately arranged at constant pitches in the axial direction of the heat transfer tube (61) so that fin surfaces may be orthogonal to the axial direction of the heat transfer tube (61).

Each flat sheet fin (65) is shaped like a vertically long flat rectangular plate. Through holes (66) for inserting the heat transfer tubes (61) therethrough are formed on the flat sheet fins (65). Cylindrical first collars (67) which are continuous with the peripheries of the through holes (66) are protrudingly provided on the flat sheet fins (65). In FIG. 11 and FIG. 12, the first collars (67) protrude from the surfaces of the flat sheet fins (65) toward the near side on the right.

The corrugated sheet fins (70) are configured as in the first embodiment. That is, the corrugated sheet fins (70) each are shaped like a corrugated sheet in which the peaks (71) and the troughs (72) are alternately formed at a certain cycle and the ridgeline direction of the waveform is orthogonal to the front edges (73) and the rear edges (74) of the corrugated sheet fins (70). Through holes (75) for inserting the heat transfer tubes (61) therethrough are formed on the corrugated sheet fins (70) and cylindrical second collars (76) which are continuous with the peripheries of the through holes (75) are protrudingly provided. In FIG. 11 and FIG. 12, the second collars (76) protrude from the surfaces of the corrugated sheet fins (70) toward the near side on the right.

Figure 13:
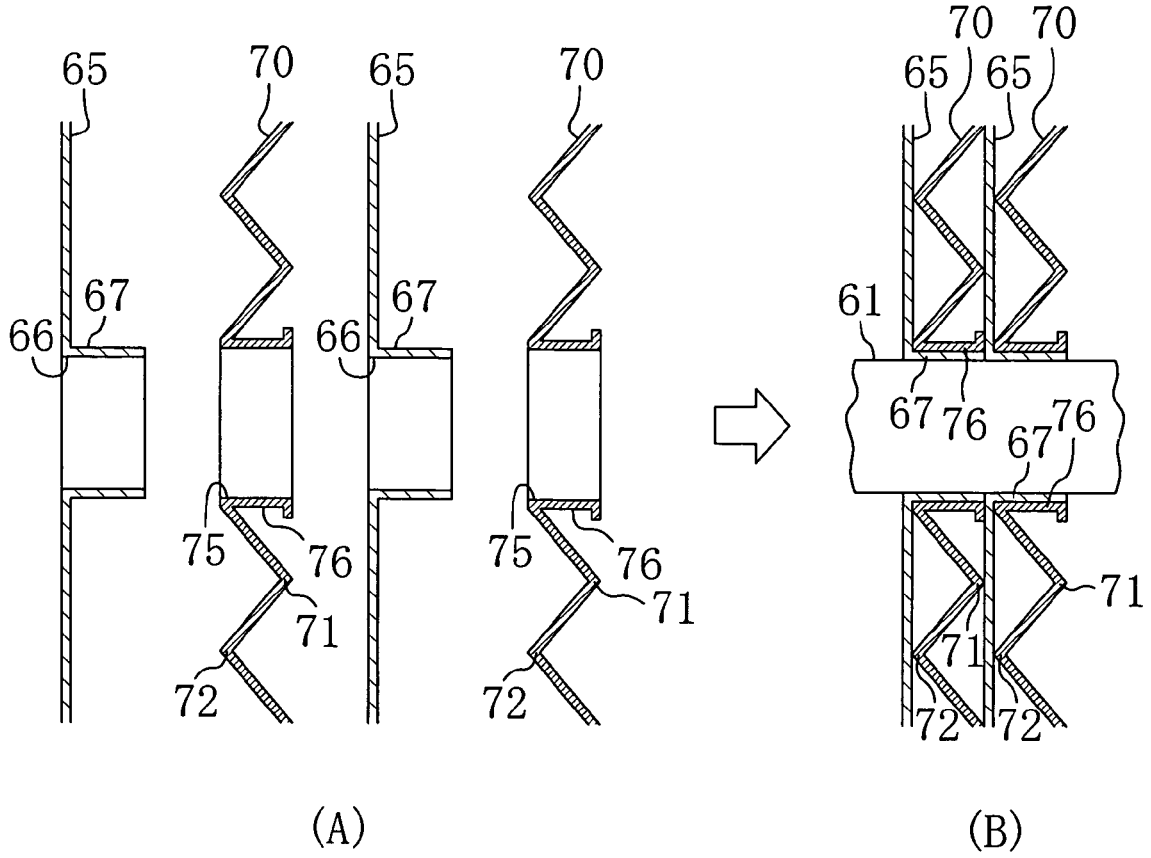
FIG. 13 is an enlarged sectional view of a main part of the heat exchanger in accordance with the second embodiment.
Figure 14:
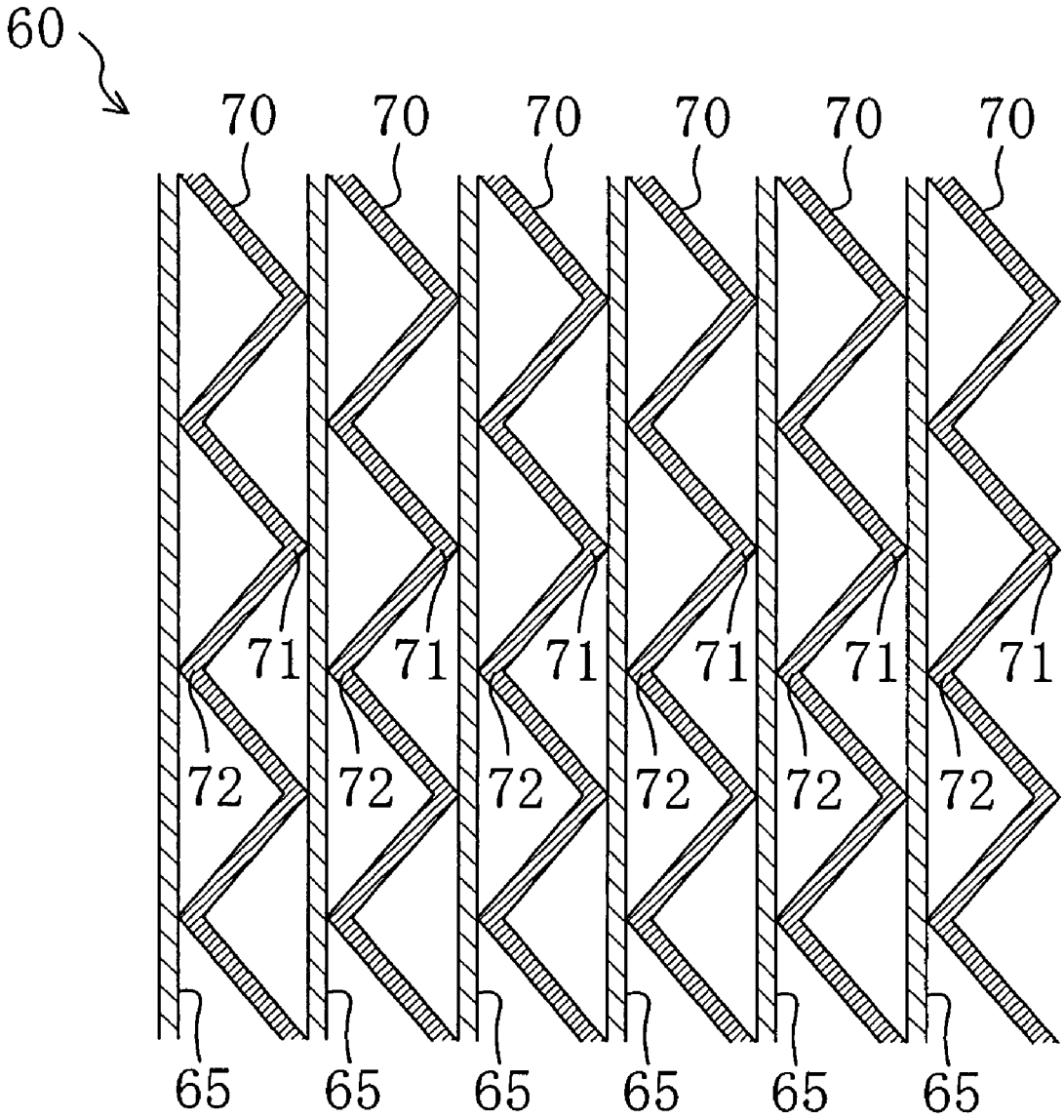
FIG. 14 is an enlarged view of a main part of the heat exchanger which shows arrangement of the corrugated sheet fins and the flat sheet fins in accordance with the second embodiment.

As shown in FIG. 13, in the heat exchanger (60), the first collars (67) of the flat sheet fins (65) are inserted into the second collars (76) of the corrugated sheet fins (70) and the heat transfer tubes (61) are inserted into the first collars (67) of the flat sheet fins (65). That is, in this heat exchanger (60), the heat transfer tubes (61) are inserted into the through holes (66, 75) of the flat sheet fins (65) and the corrugated sheet fins (70). In this heat exchanger (60), by extending the heat transfer tubes (61), the outer circumferential surfaces of the heat transfer tubes (61) come into close contact with the inner circumferential surfaces of the first collars (67) and the outer circumferential surfaces of the first collars (67) come into close contact with the inner circumferential surfaces of the second collars (76). Also in this heat exchanger (60), as shown in FIG. 14, the cycle of the waveform of the corrugated sheet fins (70) is the same.

In the heat exchanger (60) used as the first and second adsorption heat exchangers (56, 57), the adsorption layers are formed on the surfaces of the flat sheet fins (65) and the surfaces of the corrugated sheet fins (70). In the heat exchanger (60) as the adsorption heat exchangers (56, 57), air passing between the flat sheet fins (65) and the corrugated sheet fins (70) which are alternately arranged at constant pitches exchange heat with the refrigerant flowing through the heat transfer tubes (61) provided so as to pass through the flat sheet fins (65) and the corrugated sheet fin (70) and at the same time comes into contact with the adsorption layers formed on the surfaces of the flat sheet fin (65) and the corrugated sheet fin (70).

On the other hand, in the heat exchanger (60) used as the indoor heat exchanger (55), no adsorption layer is formed on the surfaces of the flat sheet fin (65) and the corrugated sheet fin (70). In the heat exchanger (60) used as the indoor heat exchanger (55), air passing between the flat sheet fins (65) and the corrugated sheet fins (70) which are alternately arranged at constant pitches exchange heat with the refrigerant flowing through the heat transfer tubes (61) provided so as to pass through the flat sheet fins (65) and the corrugated sheet fin (70).

In this embodiment, the same effects as those in the first embodiment can be obtained.

-First Modification Example of Second Embodiment-

Figure 15:
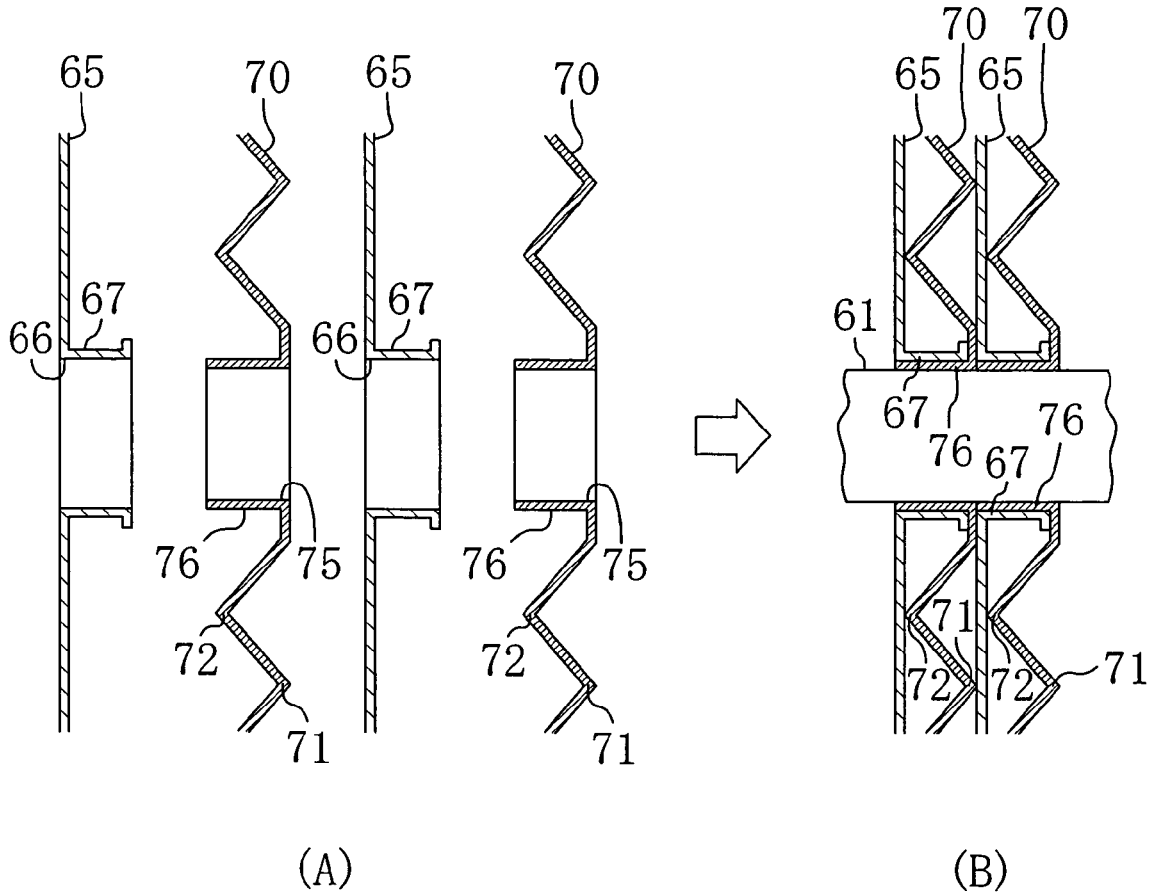
FIG. 15 is an enlarged sectional view showing a main part of a heat exchanger in accordance with a first modification example of the second embodiment.

The following configuration of the heat exchanger (60) may be adopted in this embodiment. Hereinafter, a heat exchanger (60) in a modification example will be described with reference to FIG. 15.

In this heat exchanger (60), the protruding direction of the first collars (67) on the flat sheet fins (65) is opposite to the protruding direction of the second collars (76) on the corrugated sheet fins (70). In this heat exchanger (60), the second collars (76) of the corrugated sheet fins (70) are inserted into the first collars (67) of the flat sheet fins (65) and the heat transfer tubes (61) are inserted into the second collars (76) of the corrugated sheet fins (70). That is, in the heat exchanger (60), the heat transfer tubes (61) are inserted into the through holes (66, 75) of the flat sheet fins (65) and the corrugated sheet fins (70). In the heat exchanger (60), by extending the heat transfer tubes (61), the outer circumferential surfaces of the heat transfer tubes (61) come into close contact with the inner circumferential surfaces of the second collars (76) and the outer circumferential surfaces of the second collars (76) come into close contact with the inner circumferential surfaces of the first collars (67).

-Second Modification Example of Second Embodiment-

Figure 16:
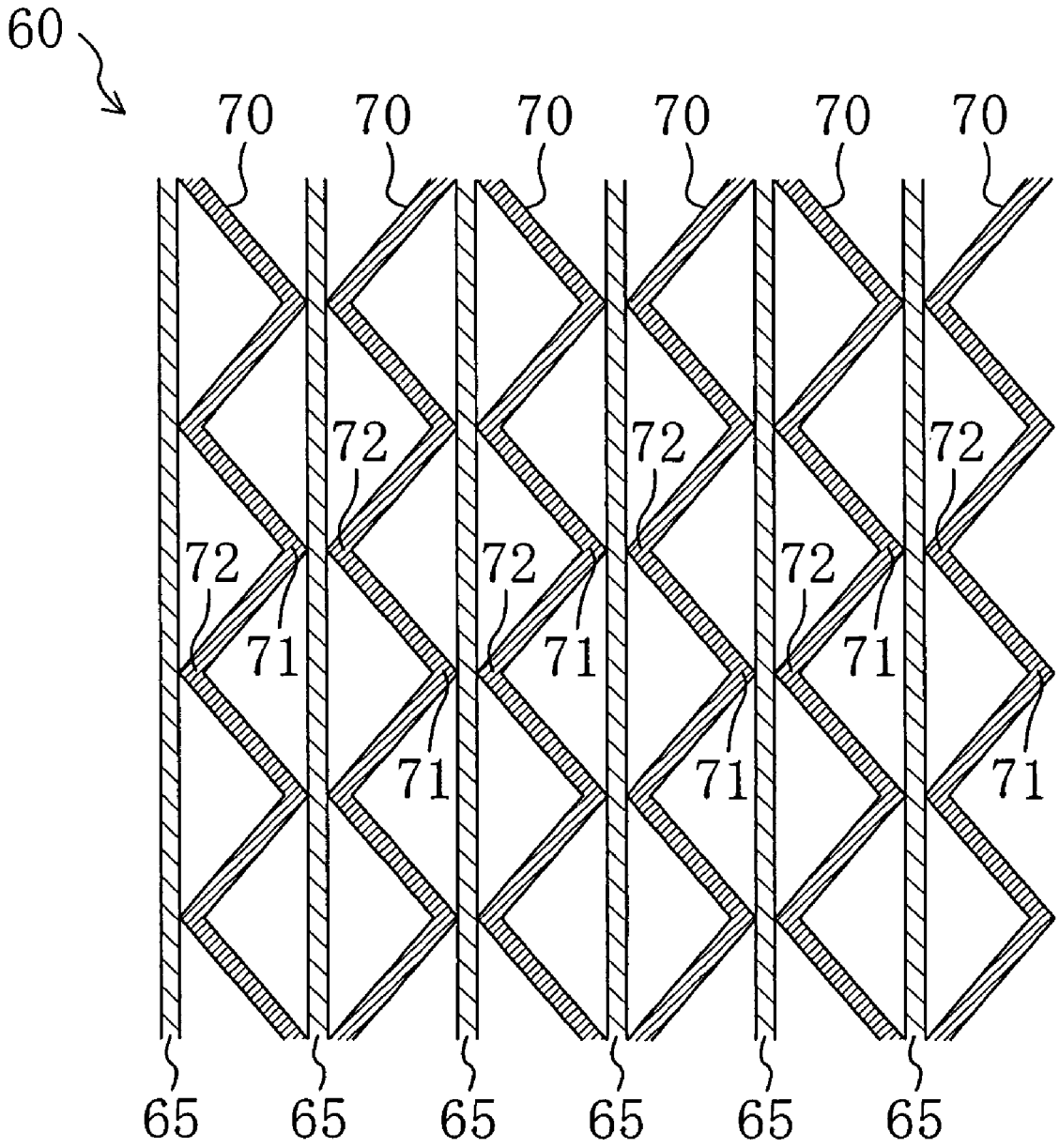
FIG. 16 is an enlarged view of a main part of a heat exchanger which shows arrangement of the corrugated sheet fins and the flat sheet fins in accordance with a second modification example of the second embodiment.

In the heat exchanger (60) in this embodiment, the cycle of the waveform of the adjacent corrugated sheet fins (70) need not be the same. For example, as shown in FIG. 16, the waveforms of a pair of the adjacent corrugated sheet fins (70) across the flat sheet fin (65) may be shifted by half cycle.

-Third Modification Example of Second Embodiment-

In this embodiment, in the heat exchanger (60) forming the adsorption heat exchangers (56, 57), the adsorption layer may be formed only on the surfaces of the corrugated sheet fins (70), or inversely, only on the surfaces of the flat sheet fins (65).

<<Third Embodiment of the Invention>>

A third embodiment of the present invention will be described. In this embodiment, in the air conditioner (10) in the second embodiment, configuration of the heat exchanger (60) used as the indoor heat exchanger (55) and the adsorption heat exchangers (56, 57) is modified. Differences between this embodiment and the second embodiment in the configuration of the heat exchanger (60) will be described.

Figure 17:
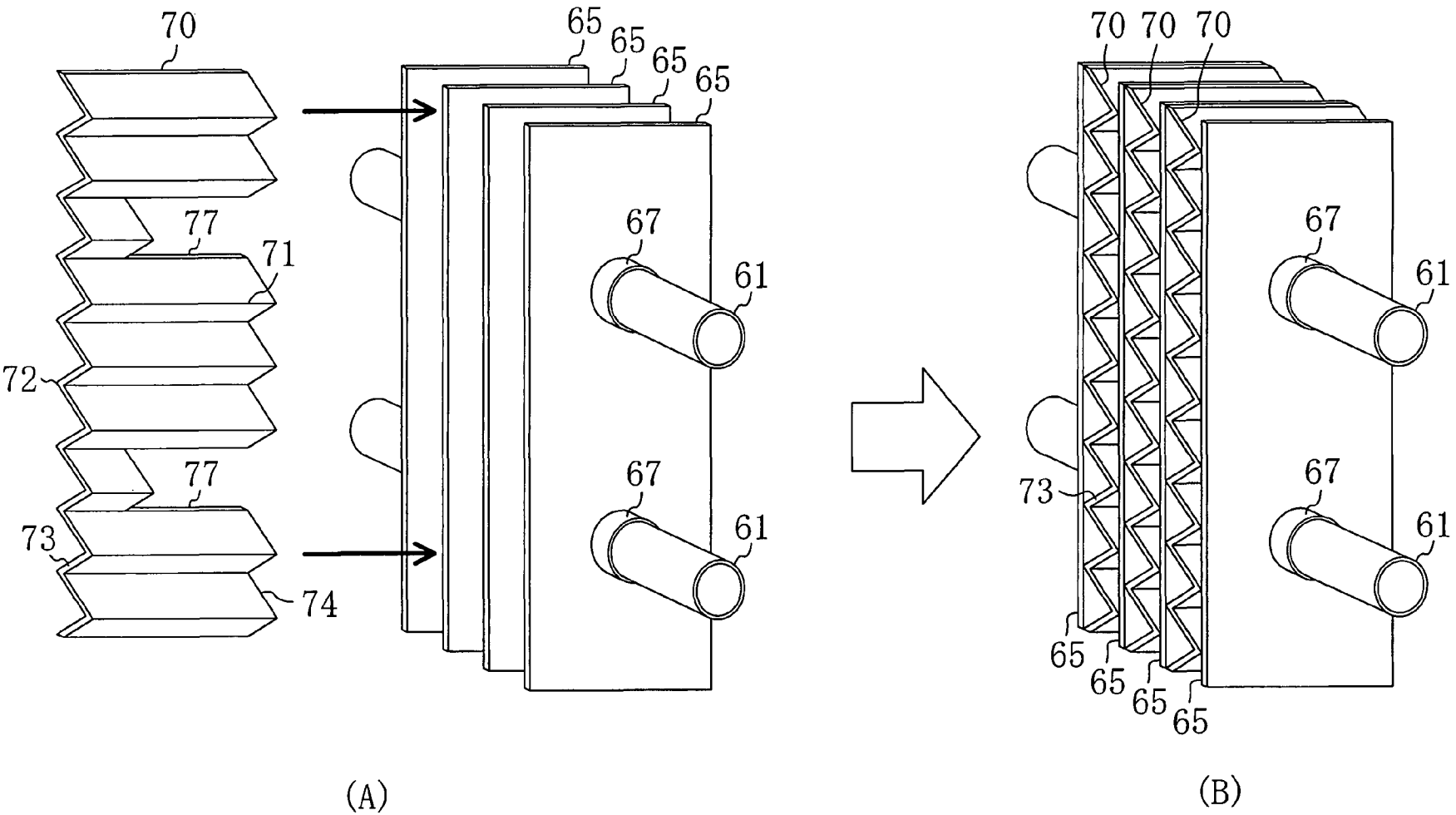
FIG. 17 is a perspective view showing schematic configuration of a heat exchanger in accordance with a third embodiment.

As shown in FIG. 17, this embodiment is different from the second embodiment in configuration of the corrugated sheet fins (70) in the heat exchanger (60). Specifically, on the corrugated sheet fins (70) in this embodiment, a plurality of notches (77) are formed and no second collar (76) is provided. The notch (77) is formed by cutting a part of the corrugated sheet fin (70) by a predetermined width from the side of the rear edge (74) toward the side of the front edge (73). The width of the notch (77) is almost the same as or larger than the outer diameter of the first collar (67) of the flat sheet fin (65). The pitch of the notches (77) on the corrugated sheet fin (70) is equal to the pitch of the first collars (67) on the flat sheet fin (65).

In the heat exchanger (60) in this embodiment, by inserting the heat transfer tubes (61) into the first collars (67) of the flat sheet fins (65) and extending the heat transfer tubes (61), the outer circumferential surfaces of the heat transfer tubes (61) come into contact with the inner circumferential surfaces of the first collars (67). The corrugated sheet fin (70) is inserted between the flat sheet fins (65) fixed to the heat transfer tubes (61) to be held between the flat sheet fins (65) located on the both sides thereof. Thus, in the heat exchanger (60) in this embodiment, the corrugated sheet fin (70) is inserted between two adjacent flat sheet fins (65) to be held between the flat sheet fins (65) located on the both sides thereof.

In the case where the adsorption heat exchangers (56, 57) are formed of this heat exchanger (60), the adsorption layers are formed on the surfaces of the flat sheet fins (65) and the surfaces of the corrugated sheet fins (70). In the case where the indoor heat exchanger (55) is formed of this heat exchanger (60), no adsorption layer is formed on the surfaces of the flat sheet fins (65) and the surfaces of the corrugated sheet fins (70). These points are the same as in the second embodiment. In this embodiment, the same effects as those in the first embodiment and the second embodiment can be obtained.

-First Modification Example of Third Embodiment-

Figure 18:
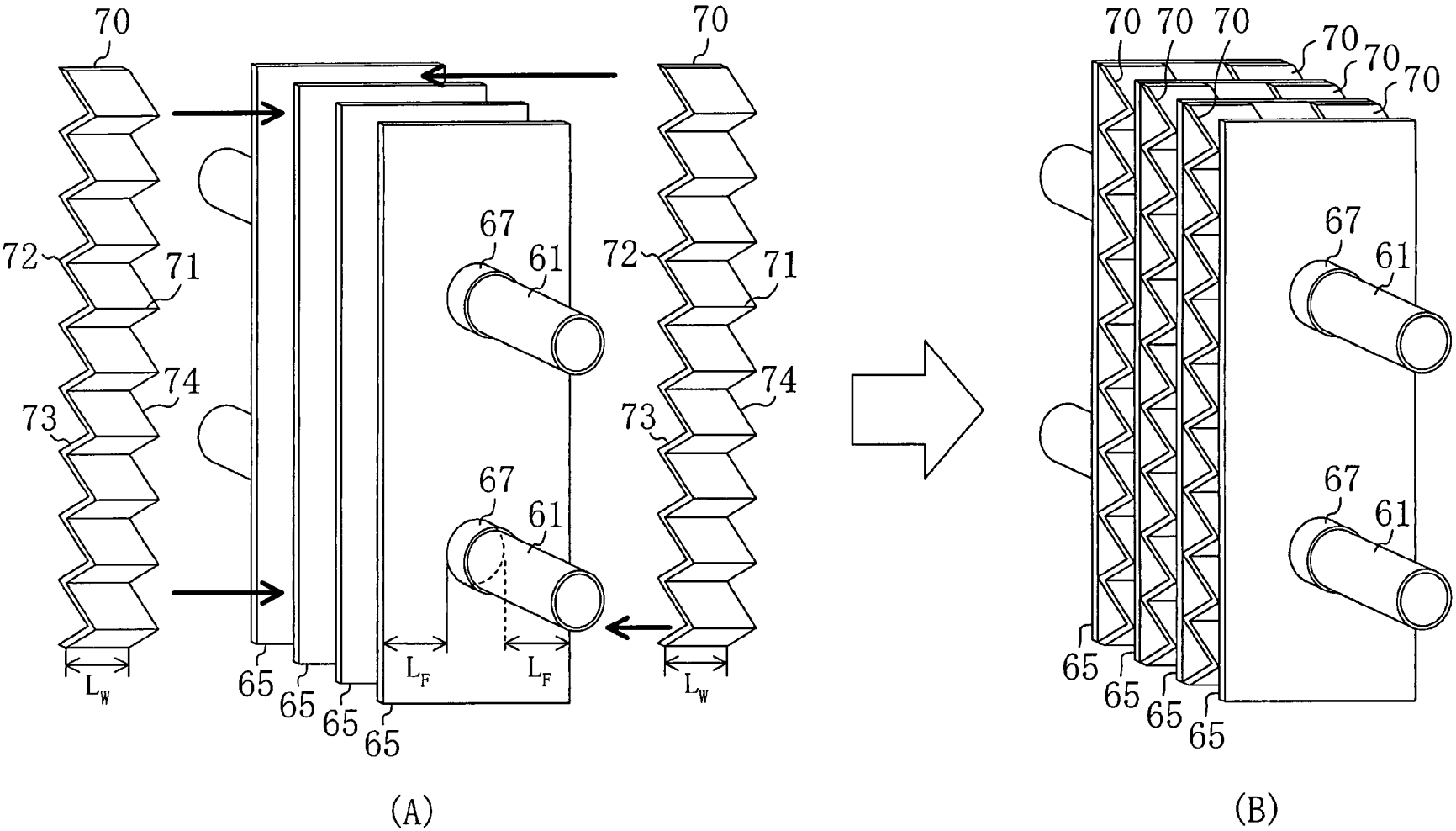
FIG. 18 is a perspective view showing schematic configuration of a heat exchanger in accordance with a first modification example of the third embodiment.

The following configuration of the heat exchanger (60) may be adopted in this embodiment. Hereinafter, a heat exchanger (60) in this modification example will be described with reference to FIG. 18.

In the heat exchanger (60) in this modification example, two corrugated sheet fins (70) are inserted between a pair of the flat sheet fins (65) arranged at constant pitches. A width $L_W$ of the corrugated sheet fin (70) is smaller than a width of the flat sheet fin (65). Specifically, the width $L_W$ of the corrugated sheet fin (70) is equal to a width $L_F$ between the first collar (67) and the front edge (73) in the flat sheet fin (65). In the flat sheet fin (65), a width between the first collar (67) and the rear edge (74) is also the width $L_F$. In the heat exchanger (60), the corrugated sheet fins (70) are held between the flat sheet fins (65) located on the both sides thereof.

-Second Modification Example of Third Embodiment-

In this embodiment, in the heat exchanger (60) forming the adsorption heat exchangers (56, 57), the adsorption layer may be formed only on the surfaces of the corrugated sheet fins (70) or inversely, only on the surfaces of the flat sheet fins (65).

<<Other Embodiments>>

First Modification Example

Figure 19:
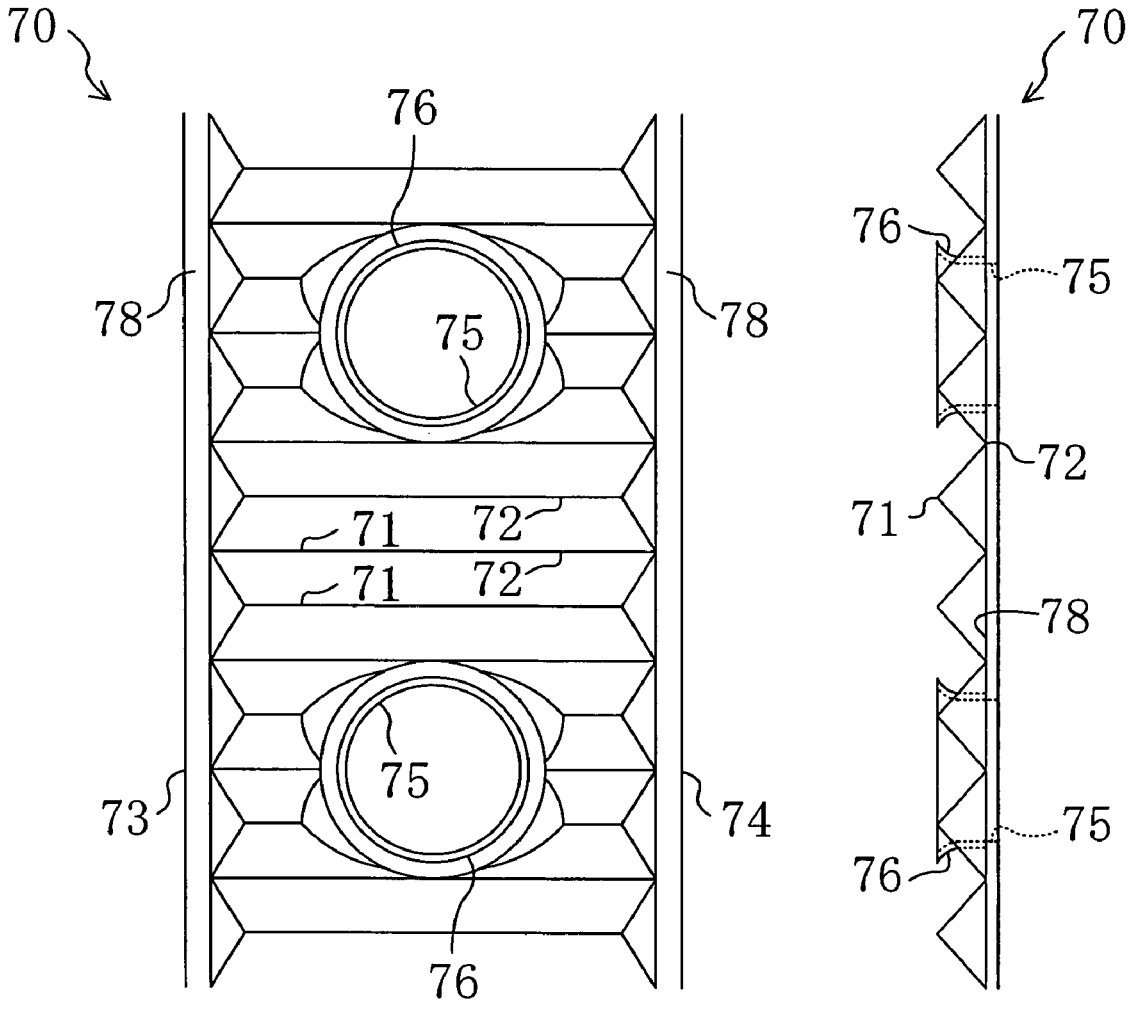
FIG. 19 is a front view and a side view of the corrugated sheet fins in accordance with a first modification example of other embodiments.

In each of the above-mentioned embodiments, flat portions (78) may be formed on the corrugated sheet fins (70) of the heat exchanger (60). As shown in FIG. 19, a relatively narrow flat portion (78) is formed on a portion along the front edge (73) and on a portion along the rear edge (74) in each corrugated sheet fin (70) in the modification example. When the flat portions (78) are formed on the corrugated sheet fins (70), rigidity of the corrugated sheet fins (70) is ensured and the corrugated sheet fins (70) are prevented from deforming in the direction orthogonal to the fin surfaces. In the corrugated sheet fins (70), the flat portion (78) may be only on the portion along the front edge (73) or only on the portion along the rear edge (74).

Second Modification Example

In each of the above-mentioned embodiments, although the waveform of the corrugated sheet fins (70) in the heat exchanger (60) is shaped like a triangle wave, the waveform of the corrugated sheet fins (70) is not limited to the triangle wave.

Figure 20:
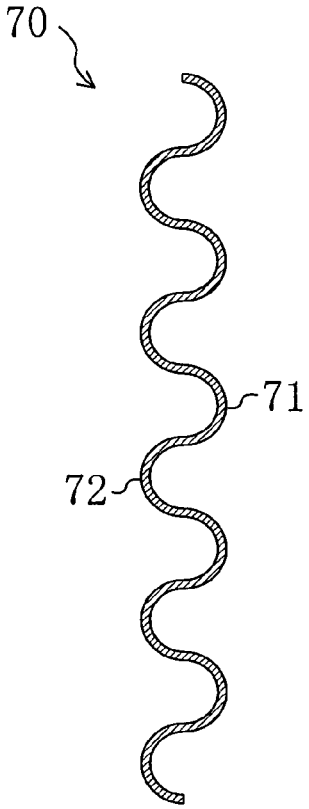
FIG. 20 is a schematic side view of the corrugated sheet fins in accordance with a second modification example of the other embodiments.

For example, as shown in FIG. 20, the waveform of the corrugated sheet fins (70) may be a curved surface wave in which a convex arc and a concave arc are alternately repeated. Even when the waveform of the corrugated sheet fins (70) is the curved surface wave, the waveform of the corrugated sheet fins (70) is not limited to the curved surface wave in which arc surfaces are repeated and may be a sine wave. When the waveform of the corrugated sheet fins (70) is the curved surface wave, a cross section of the space defined by the corrugated sheet fins (70) becomes close to a circle and thus, pressure loss of air passing through the space can be suppressed.

Figure 21:
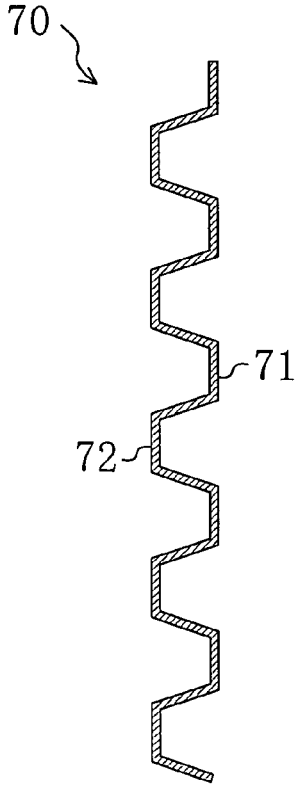
FIG. 21 is a schematic side view of the corrugated sheet fins in accordance with the second modification example of the other embodiments.

As shown in FIG. 21, the waveform of the corrugated sheet fins (70) may be a rectangular wave in which a convex trapezoid and a concave trapezoid are alternately repeated. When the waveform of the corrugated sheet fins (70) is the rectangular wave, in the heat exchanger (60) having only the corrugated sheet fins (70) in the first embodiment, the contact area between the adjacent corrugated sheet fins (70) is increased, thereby increasing quantity of heat transferred between the adjacent corrugated sheet fins (70). In this case, in the heat exchanger (60) having the corrugated sheet fins (70) and the flat sheet fins (65) in the second embodiment, contact area between the adjacent corrugated sheet fin (70) and flat sheet fin (65) is increased, thereby increasing quantity of heat transferred between the adjacent corrugated sheet fins (70) and flat sheet fins (65). Consequently, in this case, temperature of the fins provided in the heat exchanger (60) can be averaged and thus, the fin efficiency can be improved, thereby improving performances of the heat exchanger (60).

Third Modification Example

In each of the above-mentioned embodiments, in the corrugated sheet fins (70) of the heat exchanger (60), the ridgeline direction of the waveform is orthogonal to the front edges (73) and the rear edges (74) of the corrugated sheet fins (70). However, the angle which the ridgeline direction of the waveform forms with the front edges (73) and the rear edges (74) of the corrugated sheet fins (70) is not necessarily exactly 90 degrees. In each of the above-mentioned embodiments, the ridgeline direction of the waveform in the corrugated sheet fins (70) is made to be substantially orthogonal to the front edges (73) and the rear edges (74) so that flow of air passing from the front surface toward the back surface of the heat exchanger may not be obstructed by the corrugated sheet fins (70). Accordingly, if the flow of air passing through the heat exchanger is not obstructed, even when the angle which the ridgeline direction of the waveform of the corrugated sheet fins (70) forms the front edges (73) and the rear edges (74) slightly shifts from exact 90 degrees (for example, even when the angle shifts from exact 90 degrees by ±5 degrees), it can be said that the ridgeline direction of the waveform is substantially orthogonal to the front edges (73) and the rear edges (74).

Fourth Modification Example

In each of the above-mentioned embodiments, the humidity control parts are formed of the two adsorption heat exchangers (56, 57). However, the humidity control parts only need to adjust humidity of air by use of the adsorbent and thus are not limited to the adsorption heat exchangers (56, 57). For example, the humidity control part may be formed of an adsorption rotor used in general rotor-type dehumidifiers. The adsorption rotor is provided with a disk-like base material in the form of a honeycomb and an adsorption layer formed on the surface of the base material. When air is directly sent to the adsorption rotor, moisture in the air is adsorbed by the adsorption layer while air passes through the adsorption rotor, thereby dehumidifying the air. When air heated by a heater or the like is sent to the adsorption rotor, moisture is desorbed from the adsorption layer heated by air passing through the adsorption rotor and the desorbed moisture is given to the air.

INDUSTRIAL APPLICABILITY

As described hereinbefore, the present invention is effective for a heat exchanger for exchanging heat between fluid such as a refrigerant and air and for an air conditioner having the heat exchanger.

What is claimed is:

1. A heat exchanger which comprises a heat transfer tube and a plurality of fins arranged in an axial direction of the heat transfer tube and exchanges heat between fluid flowing through the heat transfer tube and air flowing between the fins, wherein a plurality of flat sheet fins which each are formed in the shape of a flat sheet and a plurality of corrugated sheet fins which each are formed in the shape of a corrugated sheet are provided as the fins, the flat sheet fins and the corrugated sheet fins are alternately arranged in the axial direction of the heat transfer tube, an amplitude direction of the waveform of the corrugated sheet fins is substantially parallel to an axial direction of the heat transfer tube, and a ridgeline direction of the waveform of the corrugated sheet fins is substantially orthogonal to a front surface and a back surface of the heat exchanger so as to correspond to an air passage direction, and each of the plurality of corrugated sheet fins includes a front edge located at one end of the waveform in the ridgeline direction and a back edge located at the other end of the waveform in the ridgeline direction, the front edge at least partially defining an inlet of the air passage and the back edge at least partially defining an outlet of the air passage, wherein the flat sheet fins and the corrugated sheet fins have through holes for inserting the heat transfer tubes therethrough, cylindrical first collars which are continuous with the peripheries of the through holes protrude from only the flat sheet fins and cylindrical second collars which are continuous with the peripheries of the through holes protrude from only the corrugated sheet fins, the second collars are engaged with the first collars, thereby bringing the outer circumferential surfaces of the second collars into close contact with the inner circumferential surfaces of the first collars, while the heat transfer tubes are engaged with the second collars, thereby bringing the inner circumferential surfaces of the second collars into close contact with the outer circumferential surfaces of the heat transfer tubes.

2. A heat exchanger which comprises a heat transfer tube and a plurality of fins arranged in an axial direction of the heat transfer tube and exchanges heat between fluid flowing through the heat transfer tube and air flowing between the fins, wherein a plurality of flat sheet fins which each are formed in the shape of a flat sheet and a plurality of corrugated sheet fins which each are formed in the shape of a corrugated sheet are provided as the fins, the flat sheet fins and the corrugated sheet fins are alternately arranged in the axial direction of the heat transfer tube, an amplitude direction of the waveform of the corrugated sheet fins is substantially parallel to an axial direction of the heat transfer tube, and a ridgeline direction of the waveform of the corrugated sheet fins is substantially orthogonal to a front surface and a back surface of the heat exchanger so as to correspond to an air passage direction, and each of the plurality of corrugated sheet fins includes a front edge located at one end of the waveform in the ridgeline direction and a back edge located at the other end of the waveform in the ridgeline direction, the front edge at least partially defining an inlet of the air passage and the back edge at least partially defining an outlet of the air passage, wherein the flat sheet fins and the corrugated sheet fins have through holes for inserting the heat transfer tubes therethrough, cylindrical first collars which are continuous with the peripheries of the through holes protrude from only the flat sheet fins and cylindrical second collars which are continuous with the peripheries of the through holes protrude from only the corrugated sheet fins, the first collars are engaged with the second collars, thereby bringing the inner circumferential surfaces of the second collars into close contact with the outer circumferential surfaces of the first collars, while the heat transfer tubes are engaged with the first collars, thereby bringing the inner circumferential surfaces of the first collars into close contact with the outer circumferential surfaces of the heat transfer tubes.

3. The heat exchanger according to claim 2 or 1, wherein each corrugated sheet fin is into contact with the flat sheet fins located on both sides of the corrugated sheet fin.

4. The heat exchanger according to claim 2, wherein flat portions are formed along sides of the corrugated sheet fins orthogonal to the ridgeline direction of the waveform thereof.

5. The heat exchanger according to claim 2 or 1, wherein adsorption layers made of adsorbent are formed on the fins and moisture is transferred between air passing between the fins and the adsorption layers.

6. The heat exchanger according to claim 2 or 1, wherein adsorption layers made of adsorbent are formed on the surfaces of either the flat sheet fins or the corrugated sheet fins, and moisture is transferred between air passing between the flat sheet fins and the corrugated sheet fins and the adsorption layers.

7. An air conditioner which comprises a temperature control part for processing sensible heat load and humidity control parts for processing latent heat load and performs at least a cooling and dehumidification operation of cooling air supplied indoors by the temperature control part and dehumidifying air supplied indoors by the humidity control parts, wherein the humidity control parts control water content in air by using adsorbent which adsorbs moisture in the air, the temperature control part is formed of a temperature control heat exchanger which exchanges heat between a heating medium for cooling and air in the cooling and dehumidification operation, the temperature control heat exchanger has a heat transfer tube and a plurality of fins in the axial direction of the heat transfer tube, exchanges heat between fluid flowing through the heat transfer tube and air flowing between the fins and has a plurality of flat sheet fin shaped like a flat sheet and a plurality of corrugated sheet fins shaped like a corrugated sheet as the fins, in the temperature control heat exchanger, the flat sheet fins and the corrugated sheet fins are alternately arranged in the axial direction of the heat transfer tube, an amplitude direction of the waveform of the corrugated sheet fins is substantially parallel to an axial direction of the heat transfer tube, and a ridgeline direction of the waveform of the corrugated sheet fins is substantially orthogonal to a front surface and a back surface of the temperature control heat exchanger so as to correspond to an air passage direction, and each of the plurality of corrugated sheet fins includes a front edge located at one end of the waveform in the ridgeline direction and a back edge located at the other end of the waveform in the ridgeline direction, the front edge at least partially defining an inlet of the air passage and the back edge at least partially defining an outlet of the air passage, wherein the flat sheet fins and the corrugated sheet fins have through holes for inserting the heat transfer tubes therethrough, cylindrical first collars which are continuous with the peripheries of the through holes protrude from only the flat sheet fins and cylindrical second collars which are continuous with the peripheries of the through holes protrude from only the corrugated sheet fins, the first collars are engaged with the second collars, thereby bringing the inner circumferential surfaces of the second collars into close contact with the outer circumferential surfaces of the first collars, while the heat transfer tubes are engaged with the first collars, thereby bringing the inner circumferential surfaces of the first collars into close contact with the outer circumferential surfaces of the heat transfer tubes.

8. An air conditioner which comprises a heat exchanger and a heating medium circuit for supplying a heating medium for cooling or heating to a heat transfer tube of the heat exchanger, alternately performs a motion of supplying the heating medium for cooling to the heat transfer tube of the heat exchanger, thereby allowing an adsorption layer of the heat exchanger to adsorb moisture in air and a motion of supplying the heating medium for heating to the heat transfer tube of the heat exchanger, thereby giving to the air the moisture desorbed from the adsorption layer of the heat exchanger, supplies one of the air dehumidified by the heat exchanger and the air humidified by the heat exchanger indoors and discharges the other of the air dehumidified by the heat exchanger and the air humidified by the heat exchanger outdoors, wherein the heat exchanger comprises a heat transfer tube and a plurality of fins arranged in an axial direction of the heat transfer tube and exchanges heat between fluid flowing through the heat transfer tube and air flowing between the fins, in the heat exchanger, adsorption layers made of adsorbent are formed on surfaces the fins and moisture is transferred between air passing between the fins and the adsorption layers, a plurality of flat sheet fins which each are formed in the shape of a flat sheet and a plurality of corrugated sheet fins which each are formed in the shape of a corrugated sheet are provided as the fins, the flat sheet fins and the corrugated sheet fins are alternately arranged in the axial direction of the heat transfer tube, an amplitude direction of the waveform of the corrugated sheet fins is substantially parallel to an axial direction of the heat transfer tube, and a ridgeline direction of the waveform of the corrugated sheet fins is substantially orthogonal to a front surface and a back surface of the heat exchanger so as to correspond to an air passage direction, and each of the plurality of corrugated sheet fins includes a front edge located at one end of the waveform in the ridgeline direction and a back edge located at the other end of the waveform in the ridgeline direction, the front edge at least partially defining an inlet of the air passage and the back edge at least partially defining an outlet of the air passage, wherein the flat sheet fins and the corrugated sheet fins have through holes for inserting the heat transfer tubes therethrough, cylindrical first collars which are continuous with the peripheries of the through holes protrude from only the flat sheet fins and cylindrical second collars which are continuous with the peripheries of the through holes protrude from only the corrugated sheet fins, the first collars are engaged with the second collars, thereby bringing the inner circumferential surfaces of the second collars into close contact with the outer circumferential surfaces of the first collars, while the heat transfer tubes are engaged with the first collars, thereby bringing the inner circumferential surfaces of the first collars into close contact with the outer circumferential surfaces of the heat transfer tubes.

9. An air conditioner which comprises a heat exchanger and a heating medium circuit for supplying a heating medium for cooling or heating to a heat transfer tube of the heat exchanger, alternately performs a motion of supplying the heating medium for cooling to the heat transfer tube of the heat exchanger, thereby allowing an adsorption layer of the heat exchanger to adsorb moisture in air and a motion of supplying the heating medium for heating to the heat transfer tube of the heat exchanger, thereby giving to the air the moisture desorbed from the adsorption layer of the heat exchanger, supplies one of the air dehumidified by the heat exchanger and the air humidified by the heat exchanger indoors and discharges the other of the air dehumidified by the heat exchanger and the air humidified by the heat exchanger outdoors, wherein the heat exchanger comprises a heat transfer tube and a plurality of fins arranged in an axial direction of the heat transfer tube and exchanges heat between fluid flowing through the heat transfer tube and air flowing between the fins, and a plurality of flat sheet fins which each are formed in the shape of a flat sheet and a plurality of corrugated sheet fins which each are formed in the shape of a corrugated sheet are provided as the fins, in the heat exchanger, the flat sheet fins and the corrugated sheet fins are alternately arranged in the axial direction of the heat transfer tube, and an amplitude direction of the waveform of the corrugated sheet fins is substantially parallel to an axial direction of the heat transfer tube, and a ridgeline direction of the waveform of the corrugated sheet fins is substantially orthogonal to a front surface and a back surface of the heat exchanger so as to correspond to an air passage direction, in the heat exchanger, the adsorption layers made of adsorbent are formed on the surfaces of either the flat sheet fins or the corrugated sheet fins, and moisture is transferred between air passing between the flat sheet fins and the corrugated sheet fins and the adsorption layers, and each of the plurality of corrugated sheet fins includes a front edge located at one end of the waveform in the ridgeline direction and a back edge located at the other end of the waveform in the ridgeline direction, the front edge at least partially defining an inlet of the air passage and the back edge at least partially defining an outlet of the air passage, wherein the flat sheet fins and the corrugated sheet fins have through holes for inserting the heat transfer tubes therethrough, cylindrical first collars which are continuous with the peripheries of the through holes protrude from only the flat sheet fins and cylindrical second collars which are continuous with the peripheries of the through holes protrude from only the corrugated sheet fins, the first collars are engaged with the second collars, thereby bringing the inner circumferential surfaces of the second collars into close contact with the outer circumferential surfaces of the first collars, while the heat transfer tubes are engaged with the first collars, thereby bringing the inner circumferential surfaces of the first collars into close contact with the outer circumferential surfaces of the heat transfer tubes.

10. An air conditioner which comprises a temperature control part for processing sensible heat load and humidity control parts for processing latent heat load and performs at least a cooling and dehumidification operation of cooling air supplied indoors by the temperature control part and dehumidifying air supplied indoors by the humidity control parts, wherein the humidity control parts control water content in air by using adsorbent which adsorbs moisture in the air, the temperature control part is formed of a temperature control heat exchanger which exchanges heat between a heating medium for cooling and air in the cooling and dehumidification operation, the temperature control heat exchanger has a heat transfer tube and a plurality of fins in the axial direction of the heat transfer tube, exchanges heat between fluid flowing through the heat transfer tube and air flowing between the fins and has a plurality of flat sheet fin shaped like a flat sheet and a plurality of corrugated sheet fins shaped like a corrugated sheet as the fins, in the temperature control heat exchanger, the flat sheet fins and the corrugated sheet fins are alternately arranged in the axial direction of the heat transfer tube, an amplitude direction of the waveform of the corrugated sheet fins is substantially parallel to an axial direction of the heat transfer tube, and a ridgeline direction of the waveform of the corrugated sheet fins is substantially orthogonal to a fron1 surface and a back surface of the temperature control heat exchanger so as to correspond to an air passage direction, and each of the plurality of corrugated sheet fins includes a front edge located at one end of the waveform in the ridgeline direction and a back edge located at the other end of the waveform in the ridgeline direction, the front edge at least partially defining an inlet of the air passage and the back edge at least partially defining an outlet of the air passage, wherein the flat sheet fins and the corrugated sheet fins have through holes for inserting the heat transfer tubes therethrough, cylindrical first collars which are continuous with the peripheries of the through holes protrude from only the flat sheet fins and cylindrical second collars which are continuous with the peripheries of the through holes protrude from only the corrugated sheet fins, the second collars are engaged with the first collars, thereby bringing the outer circumferential surfaces of the second collars into close contact with the inner circumferential surfaces of the first collars, while the heat transfer tubes are engaged with the second collars, thereby bringing the inner circumferential surfaces of the second collars into close contact with the outer circumferential surfaces of the heat transfer tubes.

11. An air conditioner which comprises a heat exchanger and a heating medium circuit for supplying a heating medium for cooling or heating to a heat transfer tube of the heat exchanger, alternately performs a motion of supplying the heating medium for cooling to the heat transfer tube of the heat exchanger, thereby allowing an adsorption layer of the heat exchanger to adsorb moisture in air and a motion of supplying the heating medium for heating to the heat transfer tube of the heat exchanger, thereby giving to the air the moisture desorbed from the adsorption layer of the heat exchanger, supplies one of the air dehumidified by the heat exchanger and the air humidified by the heat exchanger indoors and discharges the other of the air dehumidified by the heat exchanger and the air humidified by the heat exchanger outdoors, wherein the heat exchanger comprises a heat transfer tube and a plurality of fins arranged in an axial direction of the heat transfer tube and exchanges heat between fluid flowing through the heat transfer tube and air flowing between the fins, in the heat exchanger, adsorption layers made of adsorbent are formed on surfaces the fins and moisture is transferred between air passing between the fins and the adsorption layers, a plurality of flat sheet fins which each are formed in the shape of a flat sheet and a plurality of corrugated sheet fins which each are formed in the shape of a corrugated sheet are provided as the fins, the flat sheet fins and the corrugated sheet fins are alternately arranged in the axial direction of the heat transfer tube, an amplitude direction of the waveform of the corrugated sheet fins is substantially parallel to an axial direction of the heat transfer tube, and a ridgeline direction of the waveform of the corrugated sheet fins is substantially orthogonal to a front surface and a back surface of the heat exchanger so as to correspond to an air passage direction, and each of the plurality of corrugated sheet fins includes a front edge located at one end of the waveform in the ridgeline direction and a back edge located at the other end of the waveform in the ridgeline direction, the front edge at least partially defining an inlet of the air passage and the back edge at least partially defining an outlet of the air passage, wherein the flat sheet fins and the corrugated sheet fins have through holes for inserting the heat transfer tubes therethrough, cylindrical first collars which are continuous with the peripheries of the through holes protrude from only the flat sheet fins and cylindrical second collars which are continuous with the peripheries of the through holes protrude from only the corrugated sheet fins, the second collars are engaged with the first collars, thereby bringing the outer circumferential surfaces of the second collars into close contact with the inner circumferential surfaces of the first collars, while the heat transfer tubes are engaged with the second collars, thereby bringing the inner circumferential surfaces of the second collars into close contact with the outer circumferential surfaces of the heat transfer tubes.

12. An air conditioner which comprises a heat exchanger and a heating medium circuit for supplying a heating medium for cooling or heating to a heat transfer tube of the heat exchanger, alternately performs a motion of supplying the heating medium for cooling to the heat transfer tube of the heat exchanger, thereby allowing an adsorption layer of the heat exchanger to adsorb moisture in air and a motion of supplying the heating medium for heating to the heat transfer tube of the heat exchanger, thereby giving to the air the moisture desorbed from the adsorption layer of the heat exchanger, supplies one of the air dehumidified by the heat exchanger and the air humidified by the heat exchanger indoors and discharges the other of the air dehumidified by the heat exchanger and the air humidified by the heat exchanger outdoors, wherein the heat exchanger comprises a heat transfer tube and a plurality of fins arranged in an axial direction of the heat transfer tube and exchanges heat between fluid flowing through the heat transfer tube and air flowing between the fins, and a plurality of flat sheet fins which each are formed in the shape of a flat sheet and a plurality of corrugated sheet fins which each are formed in the shape of a corrugated sheet are provided as the fins, in the heat exchanger, the flat sheet fins and the corrugated sheet fins are alternately arranged in the axial direction of the heat transfer tube, and an amplitude direction of the waveform of the corrugated sheet fins is substantially parallel to an axial direction of the heat transfer tube, and a ridgeline direction of the waveform of the corrugated sheet fins is substantially orthogonal to a front surface and a back surface of the heat exchanger so as to correspond to an air passage direction, in the heat exchanger, the adsorption layers made of adsorbent are formed on the surfaces of either the flat sheet fins or the corrugated sheet fins, and moisture is transferred between air passing between the flat sheet fins and the corrugated sheet fins and the adsorption layers, and each of the plurality of corrugated sheet fins includes a front edge located at one end of the waveform in the ridgeline direction and a back edge located at the other end of the waveform in the ridgeline direction, the front edge at least partially defining an inlet of the air passage and the back edge at least partially defining an outlet of the air passage, wherein the flat sheet fins and the corrugated sheet fins have through holes for inserting the heat transfer tubes therethrough, cylindrical first collars which are continuous with the peripheries of the through holes protrude from only the flat sheet fins and cylindrical second collars which are continuous with the peripheries of the through holes protrude from only the corrugated sheet fins, the second collars are engaged with the first collars, thereby bringing the outer circumferential surfaces of the second collars into close contact with the inner circumferential surfaces of the first collars, while the heat transfer tubes are engaged with the second collars, thereby bringing the inner circumferential surfaces of the second collars into close contact with the outer circumferential surfaces of the heat transfer tubes.

* * * * *